US012241687B2

(12) United States Patent
Kitagawa et al.

(10) Patent No.: US 12,241,687 B2
(45) Date of Patent: Mar. 4, 2025

(54) HEAT EXCHANGER

(71) Applicant: DENSO CORPORATION, Kariya (JP)

(72) Inventors: Shinya Kitagawa, Kariya (JP); Takahiro Uno, Kariya (JP)

(73) Assignee: DENSO CORPORATION, Kariya (JP)

( * ) Notice: Subject to any disclaimer, the term of this patent is extended or adjusted under 35 U.S.C. 154(b) by 225 days.

(21) Appl. No.: 17/854,199

(22) Filed: Jun. 30, 2022

(65) Prior Publication Data

US 2022/0333866 A1 Oct. 20, 2022

Related U.S. Application Data

(63) Continuation of application No. PCT/JP2020/043848, filed on Nov. 25, 2020.

(30) Foreign Application Priority Data

Jan. 29, 2020 (JP) ..... 2020-012157

(51) Int. Cl.
*F28D 1/053* (2006.01)
*F28F 1/12* (2006.01)
*F28F 17/00* (2006.01)

(52) U.S. Cl.
CPC ..... *F28D 1/05391* (2013.01); *F28F 1/128* (2013.01); *F28F 17/005* (2013.01)

(58) Field of Classification Search
CPC ..... F28F 1/128; F28F 17/005; F28F 9/0224; F28F 9/001; F28F 2225/06; F28D 1/05391
See application file for complete search history.

(56) References Cited

U.S. PATENT DOCUMENTS 5,481,886 A 1/1996 Hasegawa et al.
2002/0134535 A1* 9/2002 Nozaki ..... F28F 9/001 165/149
2019/0049194 A1* 2/2019 Yanik ..... F28F 1/022

FOREIGN PATENT DOCUMENTS

JP H07172152 A 7/1995
JP 2013083392 A * 5/2013 ..... F25B 39/00
JP 2014043985 A 3/2014

* cited by examiner

*Primary Examiner* — Frantz F Jules
*Assistant Examiner* — Martha Tadesse
(74) *Attorney, Agent, or Firm* — Harness, Dickey & Pierce, P.L.C.

(57) ABSTRACT

A heat exchanger includes: a plurality of tubes arranged in an up-down direction; and a reinforcing plate arranged on a lower side of a lowermost tube of the plurality of tubes. The reinforcing plate has a bent portion protruding downward and extending along a longitudinal direction of the tube. The bent portion includes at least one discharge hole to discharge a condensed water. The discharge hole is formed by an upstream rib extending from the upper side toward the discharge hole in an upstream region and a downstream rib extending from the upper side toward the discharge hole in a downstream region, and a height dimension of the upstream rib is different from a height dimension of the downstream rib at least partially along a longitudinal direction of the tube.

13 Claims, 19 Drawing Sheets

HEAT EXCHANGER

CROSS REFERENCE TO RELATED APPLICATIONS

The present application is a continuation application of International Patent Application No. PCT/JP2020/043848 filed on Nov. 25, 2020, which designated the U.S. and claims the benefit of priority from Japanese Patent Application No. 2020-012157 filed on Jan. 29, 2020. The entire disclosures of all of the above applications are incorporated herein by reference.

TECHNICAL FIELD

The present disclosure relates to a heat exchanger that exchanges heat between heat medium and air.

BACKGROUND

A heat exchanger recovers heat from air by exchanging heat with a heat medium such as a refrigerant. In the heat exchanger, a low-temperature heat medium that passes through the inside of the tube exchanges heat with air that passes through the outside of the tube.

SUMMARY

According to an aspect of the present disclosure, a heat exchanger exchanges heat between heat medium and air. The heat exchanger includes: a plurality of tubes arranged in an up-down direction, through which the heat medium passes; and a reinforcing plate arranged on a lower side of a lowermost tube of the plurality of tubes. The reinforcing plate has a bent portion protruding downward and extending along a longitudinal direction of the tube. The bent portion includes at least one discharge hole to discharge a condensed water flowing from an upper side toward a lower side. The bent portion has a lower end to define an upstream region upstream of the lower end in a flow direction of air and a downstream region downstream of the lower end in a flow direction of air. The discharge hole is formed by an upstream rib extending from the upper side toward the discharge hole in the upstream region and a downstream rib extending from the upper side toward the discharge hole in the downstream region. A height dimension of the upstream rib is different from a height dimension of the downstream rib partially at least along the longitudinal direction of the tube.

DESCRIPTION OF EMBODIMENTS

Figure 1:
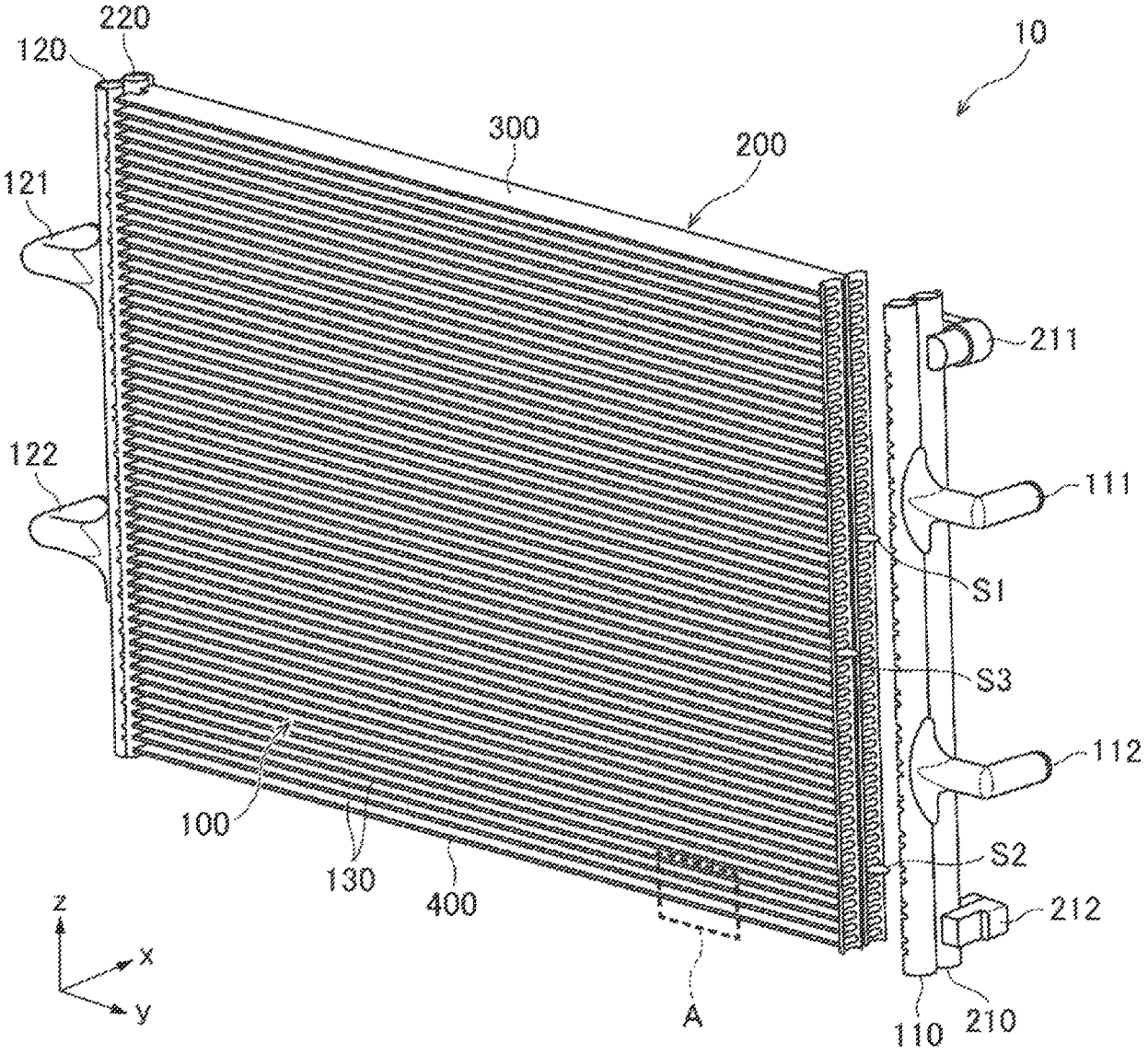
FIG. 1 is a diagram showing an overall configuration of a heat exchanger according to a first embodiment.

To begin with, examples of relevant techniques will be described.

For example, as an evaporator provided in a heat pump system, a heat exchanger recovers heat from air by exchanging heat with a heat medium such as a refrigerant. In the heat exchanger, a low-temperature heat medium that passes through the inside of the tube exchanges heat with air that passes through the outside of the tube.

The air passing through the heat exchanger contains water vapor. Therefore, when the air is cooled as passing through the outside of the tube, the water vapor contained in the air becomes condensed water and adheres to the surface of the tube or fin. The condensed water may form frost and adhere to the surface of tube or fin.

The condensed water and water generated by melting the frost are referred to "condensed water". The condensed water moves downward due to gravity along the surface of the tube or fin.

The heat exchanger has a reinforcing plate, which is a plate-shaped member, in order to sandwich and protect tubes and fins. When the tubes extend in the horizontal direction and are arranged in the vertical direction, the reinforcing plate is arranged at the upper side and the lower side in the vertical direction. Specifically, a reinforcing plate is arranged on the upper side of the uppermost tube and another reinforcing plate is arranged on the lower side of the lowermost tube.

In the heat exchanger having such a configuration, there is a concern that the condensed water that has moved downward due to gravity stays on the upper surface of the reinforcing plate arranged at the lower side. Therefore, in a heat exchanger, a hole for discharging the cooling water to the lower side is formed in the reinforcing plate (side plate) on the lower side.

The reinforcing plate is required to have a certain degree of rigidity. Therefore, the present inventors study a configuration for forming a bent portion that protrudes downward with respect to the reinforcing plate. If such a bent portion is formed in a straight line so as to extend in the longitudinal direction of the reinforcing plate, that is, along the longitudinal direction of the tube, the rigidity of the reinforcing plate can be increased.

In the reinforcing plate having such a configuration, the condensed water tends to flow into the bent portion. Therefore, it is conceivable to form a discharge hole in the bent portion for discharging the cooling water. However, the condensed water existing inside the bent portion has a relatively strong surface tension to stay in the bent portion. For example, it is difficult to sufficiently discharge the condensed water simply by forming a discharge hole that passing through the bottom of the bent portion. It is not preferable from the viewpoint of cost to separately provide a drainage guide in order to promote the discharge of condensed water.

The present disclosure provides a heat exchanger capable of sufficiently draining the condensed water.

According to the present disclosure, a heat exchanger exchanges heat between heat medium and air. The heat exchanger includes: a plurality of tubes arranged in an up-down direction, through which the heat medium passes; and a reinforcing plate arranged on a lower side of a lowermost tube of the plurality of tubes. The reinforcing plate has a bent portion protruding downward and extending along a longitudinal direction of the tube. The bent portion includes at least one discharge hole to discharge a condensed water flowing from an upper side toward a lower side. The bent portion has a lower end to define an upstream region upstream of the lower end in a flow direction of air and a downstream region downstream of the lower end in a flow direction of air. The discharge hole is formed by an upstream rib extending from the upper side toward the discharge hole in the upstream region and a downstream rib extending from the upper side toward the discharge hole in the downstream region. A height dimension of the upstream rib is different from a height dimension of the downstream rib partially at least along the longitudinal direction of the tube.

In the heat exchanger having such a configuration, the reinforcing plate arranged on the lower side of the tubes has the bent portion protruding toward the lower side. Further, a discharge hole for discharging the condensed water downward is formed in the bent portion. As a result, the condensed water flows into the bent portion from the upper side and then is discharged to the outside through the discharge hole.

The discharge hole is formed so that the height dimension of the upstream rib and the height dimension of the downstream rib are different from each other partially at least along the longitudinal direction of the tube. In other words, at least partially, one of the upstream rib and the downstream rib protrudes further downward than the other, and the protruding part faces the discharge hole. In such a configuration, the surface tension acting on the condensed water in the vicinity of the discharge hole can be made relatively small. Therefore, the condensed water moves downward along the protruding part and is smoothly discharged to the outside from the discharge hole facing the protruding part.

As described above, in the heat exchanger having the above configuration, it is possible to sufficiently drain the condensed water by forming the discharge hole at position deviated from the center of the bent portion in the flow direction of air, not at the center of the bent portion in the flow direction of air.

According to the present disclosure, there is provided a heat exchanger capable of sufficiently draining a condensed water.

Hereinafter, embodiments will be described with reference to the attached drawings. In order to facilitate the ease of understanding, the same reference numerals are attached to the same constituent elements in the drawings where possible, and redundant explanations are omitted.

A heat exchanger 10 according to a first embodiment will be described. The heat exchanger 10 is mounted on a vehicle (not shown). As shown in FIG. 1, the heat exchanger 10 is configured as a composite heat exchanger in which a radiator 100 and an evaporator 200 are combined and integrated.

The radiator 100 is a heat exchanger for cooling a cooling water whose temperature becomes high after passing through a heating element (not shown), and the cooling water exchanges heat with air. The "heating element" means a device mounted on the vehicle and requiring cooling, for example, an internal combustion engine, an intercooler, a motor, an inverter, a battery, or the like. The evaporator 200 is a part of an air conditioner (not shown) mounted on the vehicle, and is a heat exchanger for evaporating a liquid phase refrigerant by heat exchange with air. As described above, the heat exchanger 10 is configured as a heat exchanger that exchanges heat between the heat medium and the air. In the radiator 100, the cooling water corresponds to a "heat medium". In the evaporator 200, the refrigerant corresponds to a "heat medium".

First, the configuration of the radiator 100 will be described. The radiator 100 includes tanks 110 and 120, tubes 130, and fins 140. Note that the fins 140 are not shown in FIG. 1.

The tank 110, 120 is a container for temporarily storing the cooling water, which is a heat medium. Each of the tanks 110 and 120 is an approximately cylindrical container and arranged such that longitudinal direction of the tank 110, 120 is positioned along the vertical direction. The tanks 110 and 120 are arranged at positions separated from each other in the horizontal direction, and the tubes 130 and the fins 140 are arranged between the tanks 110 and 120.

The tank 110 is integrated with the tank 210 of the evaporator 200. Similarly, the tank 120 is integrated with the tank 220 of the evaporator 200. FIG. 1 shows a state in which the tank 110 and the tank 210 are removed from the heat exchanger 10 in order to show the internal configuration of the tank 110 and the tank 210.

The tank 110 has receiving portions 111 and 112 for receiving the cooling water after passing through the heating element. The receiving portion 111 is provided at a position on the upper side of the tank 110. The receiving portion 112 is provided at a position on the lower side of the tank 110.

As shown in FIG. 1, the internal space of the tank 110 is divided into upper and lower parts by a separator S3. The cooling water from the receiving portion 111 flows into the upper part of the internal space of the tank 110 above the separator S3. The cooling water from the receiving portion 112 flows into the lower part of the internal space of the tank 110 below the separator S3.

The tank 120 has discharge portions 121 and 122 for discharging the cooling water to the outside after being subjected to heat exchange. The discharge portion 121 is provided at a position on the upper side of the tank 120. The discharge portion 122 is provided at a position on the lower side of the tank 120.

A separator similar to the separator S3 is arranged inside the tank 120 at a position at the same height as the separator S3. The internal space of the tank 120 is divided into upper and lower parts by the separator. The cooling water that has flowed into the internal space above the separator in the tank 120 is discharged to the outside from the discharge portion 121. The cooling water that has flowed into the internal space below the separator in the tank 120 is discharged to the outside from the discharge portion 122.

The tube 130 is a tubular member through which the cooling water passes, and the radiator 100 has the plural tubes 130. Each tube 130 is an elongated straight tube and is arranged so as to extend along the horizontal direction. One end of the tube 130 is connected to the tank 110, and the other end is connected to the tank 120. Accordingly, the inside space of the tank 110 communicates with the inside space of the tank 120 through the tubes 130.

The tubes 130 are arranged in the vertical direction, that is, along the longitudinal direction of the tank 110. The fin 140 is arranged between the tubes 130 adjacent to each other in the vertical direction, but the fins 140 are not shown in FIG. 1.

The cooling water supplied from the outside to the tank 110 flows into the tank 120 through the tube 130. As the cooling water passes through the inside of the tube 130, the cooling water is cooled by the air passing through the outside of the tube 130 such that the temperature is lowered. The flow direction of the air is perpendicular to both the longitudinal direction of the tank 110 and the longitudinal direction of the tube 130, and air flows from the radiator 100 to the evaporator 200. A fan (not shown) for sending air in the flow direction is provided in the vicinity of the heat exchanger 10.

Figure 2:
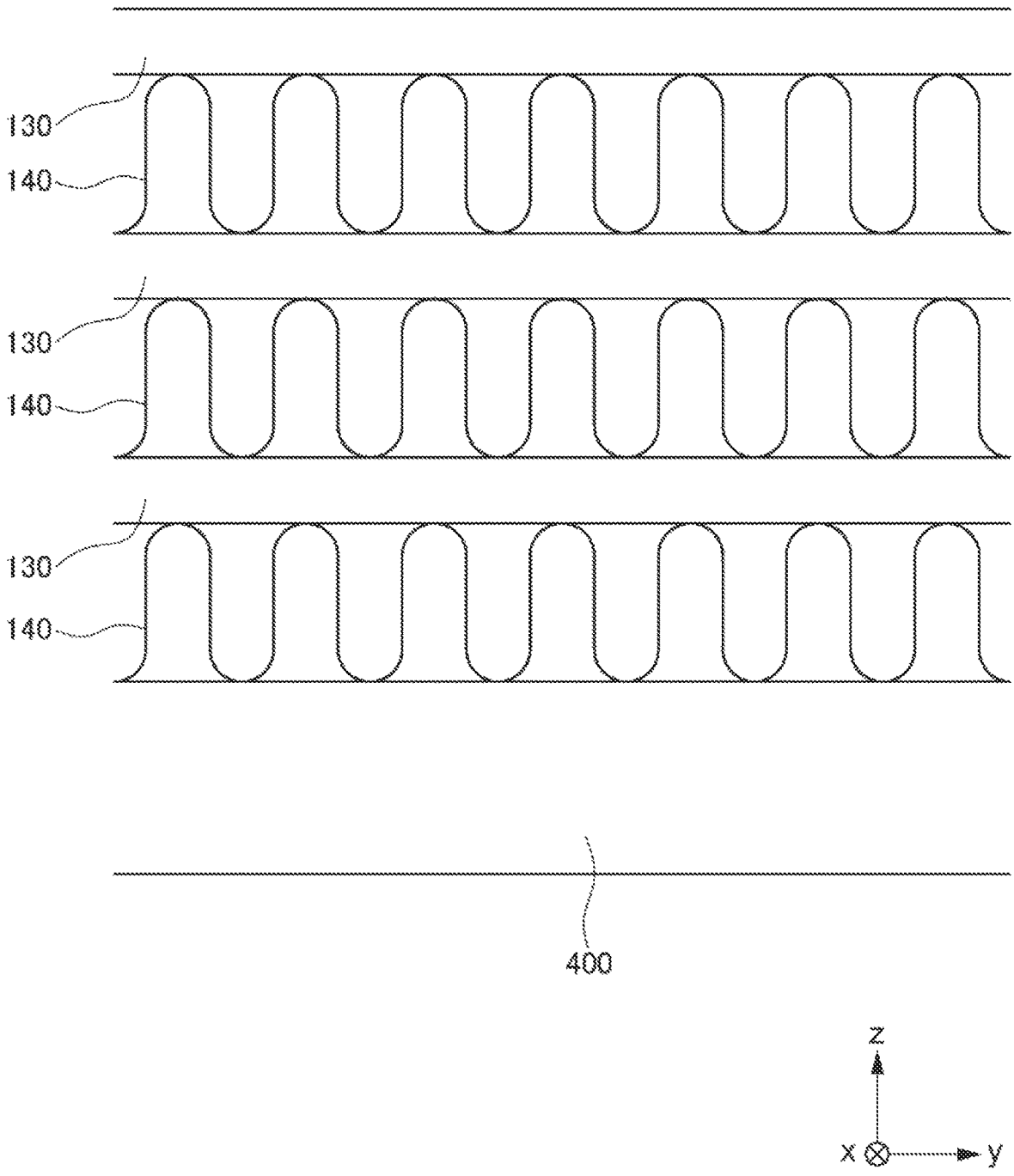
FIG. 2 is an enlarged view showing an area A in FIG. 1.

The fin 140 is a corrugated fin formed by bending a metal plate in a wavy shape. As described above, the fin 140 is arranged at positions between the tubes 130 adjacent to each other in the vertical direction. That is, in the radiator 100, the fins 140 and the tubes 130 are stacked so as to be alternately arranged in the vertical direction. FIG. 2 is an enlarged view showing the area A in FIG. 1. As shown in FIG. 2, the top of the wavy fin 140 abuts and is brazed to the surface of the tube 130 adjacent in the vertical direction.

When the cooling water passes through the inside of the tube 130, the heat of the cooling water is transferred to the air through the tube 130 and also to the air through the tube 130 and the fin 140. That is, the contact area with the air is increased by the fin 140, thereby the heat exchange between the air and the cooling water is efficiently performed.

The configuration of the evaporator 200 will be described with reference to FIG. 1. The evaporator 200 includes tanks 210 and 220, tubes 230, and fins 140.

The tank 210, 220 is a container for temporarily storing the refrigerant, which is a heat medium. Each of the tanks 110 and 120 has an approximately cylindrical shape and is arranged such that longitudinal direction of the tank 110, 120 is positioned along the vertical direction. The tanks 210 and 220 are arranged at positions separated from each other in the horizontal direction, and the tubes 230 and the fins 140 are arranged between the tanks 210 and 220.

As described above, the tank 210 is integrated with the tank 110 of the radiator 100. Similarly, the tank 220 is integrated with the tank 120 of the radiator 100.

The tank 210 has a receiving portion 211 and a discharge portion 212. The receiving portion 211 receives the refrigerant circulating in the air conditioner. The receiving portion 211 is supplied with a low-temperature liquid-phase refrigerant after passing through an expansion valve (not shown) provided in the air conditioner. The receiving portion 211 is provided at a position near the upper end of the tank 210. The discharge portion 212 discharges the refrigerant to the outside after being subjected to heat exchange. The gas phase refrigerant evaporated by heat exchange in the evaporator 200 is discharged to the outside from the discharge portion 212, and then supplied to a compressor (not shown) of the air conditioner.

As shown in FIG. 1, the internal space of the tank 210 is divided into three parts by separators S1 and S2 in the up-down direction. The receiving portion 211 is provided at a position above the separator S1 on the upper side. The discharge portion 212 is provided at a position below the separator S2 on the lower side.

The internal space of the tank 220 is divided into upper and lower parts by a separator (not shown). The position of the separator is lower than the separator S1 and higher than the separator S2.

The tube 230 is a tubular member through which the refrigerant passes, and the evaporator 200 has the plural tubes 230. Each tube 230 has an elongated straight shape and is arranged so as to extend in the horizontal direction. One end of the tube 230 is connected to the tank 210, and the other end is connected to the tank 220. Accordingly, the inside space of the tank 210 communicates with the inside space of the tank 220 through the tubes 230.

The tubes 230 are arranged in the vertical direction, that is, along the longitudinal direction of the tank 210. In this embodiment, each tube 230 is arranged adjacent to the tube 130 in the flow direction of air. That is, the same number of tubes 230 are provided as the number of tubes 130, and the tubes 230 are arranged at the same height as the tubes 130.

The refrigerant from the outside to the receiving portion 211 flows into the upper part of the internal space of the tank 210 above the separator S1. The refrigerant passes through the inside of the tube 230 arranged above the separator S1 and flows into the upper part of the internal space of the tank 220 above the non-illustrated separator. After that, the refrigerant passes through the inside of the tube 230 arranged above the separator and below the separator S1 and flows into the internal space of the tank 210 between the separator S1 and the separator S2.

Further, after that, the refrigerant passes through the inside of the tube 230 arranged above the separator S2 and below the separator in the tank 220, and flows into the lower part of the internal space of the tank 220 below the separator. The refrigerant passes through the inside of the tube 230 arranged below the separator S2, flows into the lower part of the internal space of the tank 210 below the separator S2, and then is discharged to the outside from the discharge portion 212.

When passing through the inside of each tube 230 as described above, the refrigerant is heated and evaporated by the air passing through the outside of the tube 230, and changes from a liquid phase to a gas phase. The air has passed through the radiator 100 and the temperature is raised before heating the refrigerant. The temperature of the air is lowered since the heat of the air is absorbed by the refrigerant as passing outside the tube 230.

Figure 3:
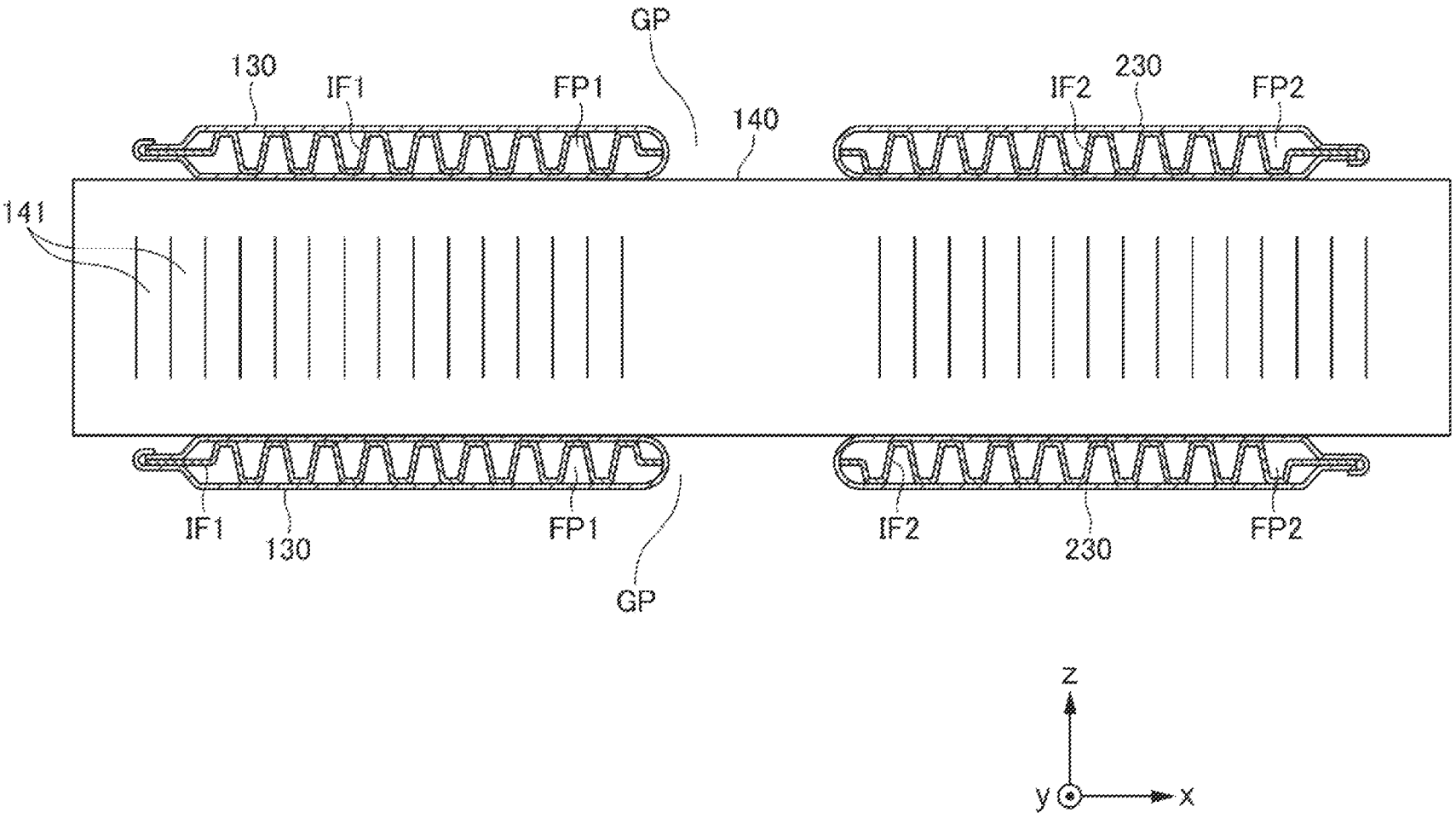
FIG. 3 is a diagram showing a fin and tubes arranged above and below the fin in the heat exchanger.

The fin 140 (not shown in FIG. 1) is arranged between the tubes 230 adjacent to each other in the vertical direction. The fin 140 is included in the radiator 100 described above. As shown in FIG. 3, each fin 140 is arranged so as to extend from a position between the tubes 130 of the radiator 100 to a position between the tubes 230 of the evaporator 200. That is, each fin 140 is shared by the radiator 100 and the evaporator 200.

Therefore, the fins 140 and the tubes 230 are stacked so as to be alternately arranged in the vertical direction, in the evaporator 200, as in the radiator 100 described with reference to FIG. 2. The top of the wavy fin 140 is in contact with and brazed to the surface of the adjacent tube 230 in the vertical direction.

When the refrigerant passes through the inside of the tube 230, the heat of the air is transferred to the refrigerant through the tube 230 and also to the refrigerant through the tube 230 and the fin 140. That is, the contact area with the air is increased by the fin 140, thereby the heat exchange between the air and the refrigerant is efficiently performed.

In the present embodiment, the heat of the cooling water passing through the inside of the tube 130 is further transferred to the refrigerant passing through the inside of the tube 230 by heat conduction through the fin 140. In the evaporator 200, not only the heat from the air but also the heat from the cooling water is recovered, so that the operating efficiency of the air conditioner is further improved.

As shown in FIG. 1, a reinforcing plate 300, which is a plate-shaped member, is arranged at a position on the upper side of the tube 130, 230 located on the uppermost side. Further, a reinforcing plate 400, which is a plate-shaped member, is arranged at a position on the lower side of the tube 130, 230 located on the lowermost side. The reinforcing plate 300, 400 is a metal plate provided to reinforce the tube 130 and the like to restrict their deformation. As shown in FIG. 2, the fin 140 is also arranged between the reinforcing plate 400 and the tube 130, 230 positioned on the lowermost side.

In FIG. 1, the flow direction of air is represented by the x direction from the radiator 100 to the evaporator 200, and the x-axis is set along the flow direction of air. Further, the y direction perpendicular to the x direction is set from the tank 120 to the tank 110, that is, the longitudinal direction of the tube 130, and the y-axis is set along the longitudinal direction of the tube 130. Further, the z direction perpendicular to both the x direction and the y direction is set from the lower side to the upper side, that is, the longitudinal direction of the tank 110, and the z-axis is along the longitudinal direction of the tank 110. Hereinafter, the description will be given using the x direction, y direction, and z direction.

FIG. 3 shows one fin 140 and cross section of the tubes 130 and 230 arranged on the upper and lower sides of the fin 140. As shown in FIG. 3, each of the tubes 130 and 230 has a flat cross section extending in the x direction. A flow path FP1 through which the cooling water passes is formed inside the tube 130. An inner fin IF1 is arranged in the flow path FP1. Similarly, a flow path FP2 through which the refrigerant passes is formed inside the tube 230. An inner fin IF2 is arranged in the flow path FP2. A gap GP is formed between the tube 130 and the tube 230 arranged at the same height.

As shown in FIG. 3, louvers 141 are formed on the fin 140. The louver 141 is formed by cutting and bending a part of the fin 140. Specifically, plural linear notches extending in the z direction are formed on the flat portion of the fin 140 so as to be arranged in the x direction, and then the area between the notches adjacent to each other is bent to form the louver 141. The air passes through the gap formed in the vicinity of the louver 141, such that the heat exchange with the air is performed more efficiently. As the shape of the louver 141, the louver formed on the conventional fin can be adopted.

Figure 4:
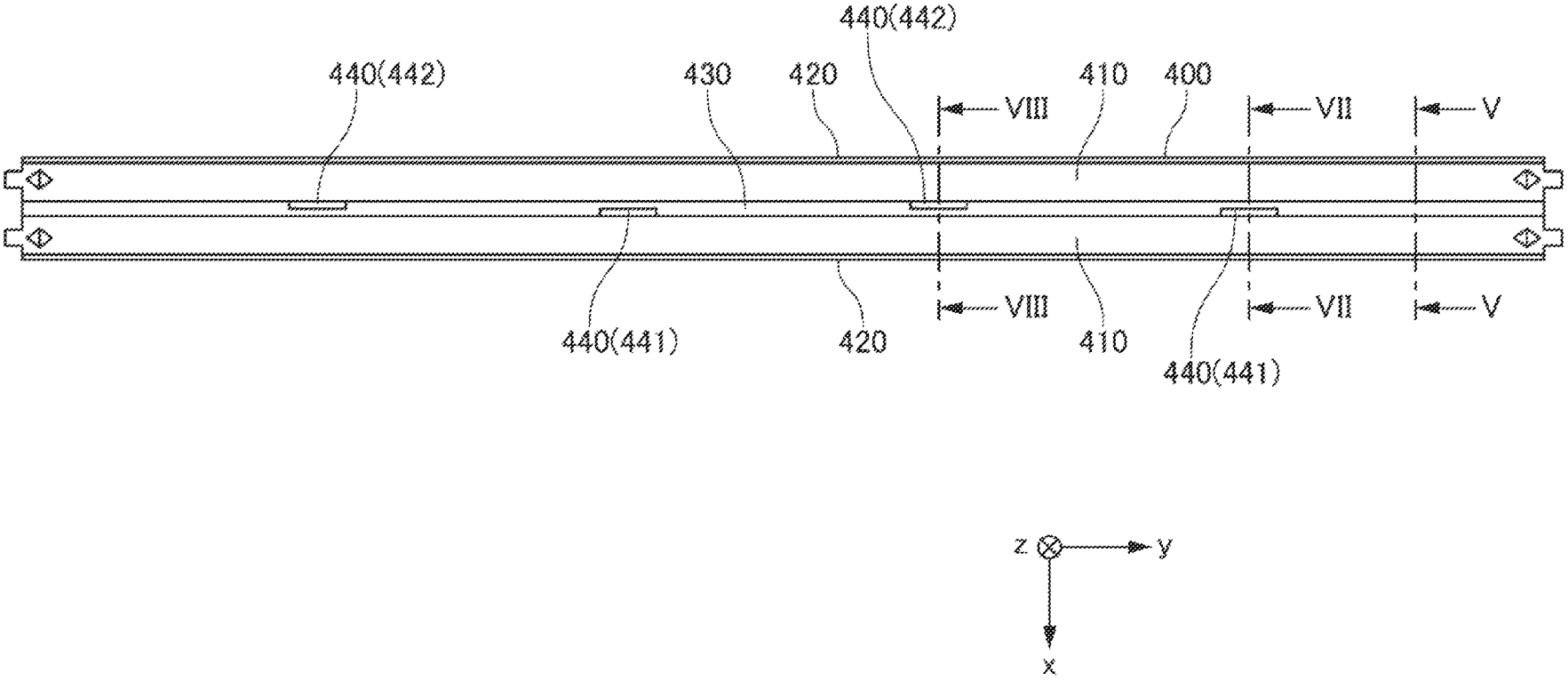
FIG. 4 is a diagram showing a configuration of a reinforcing plate included in the heat exchanger.
Figure 5:
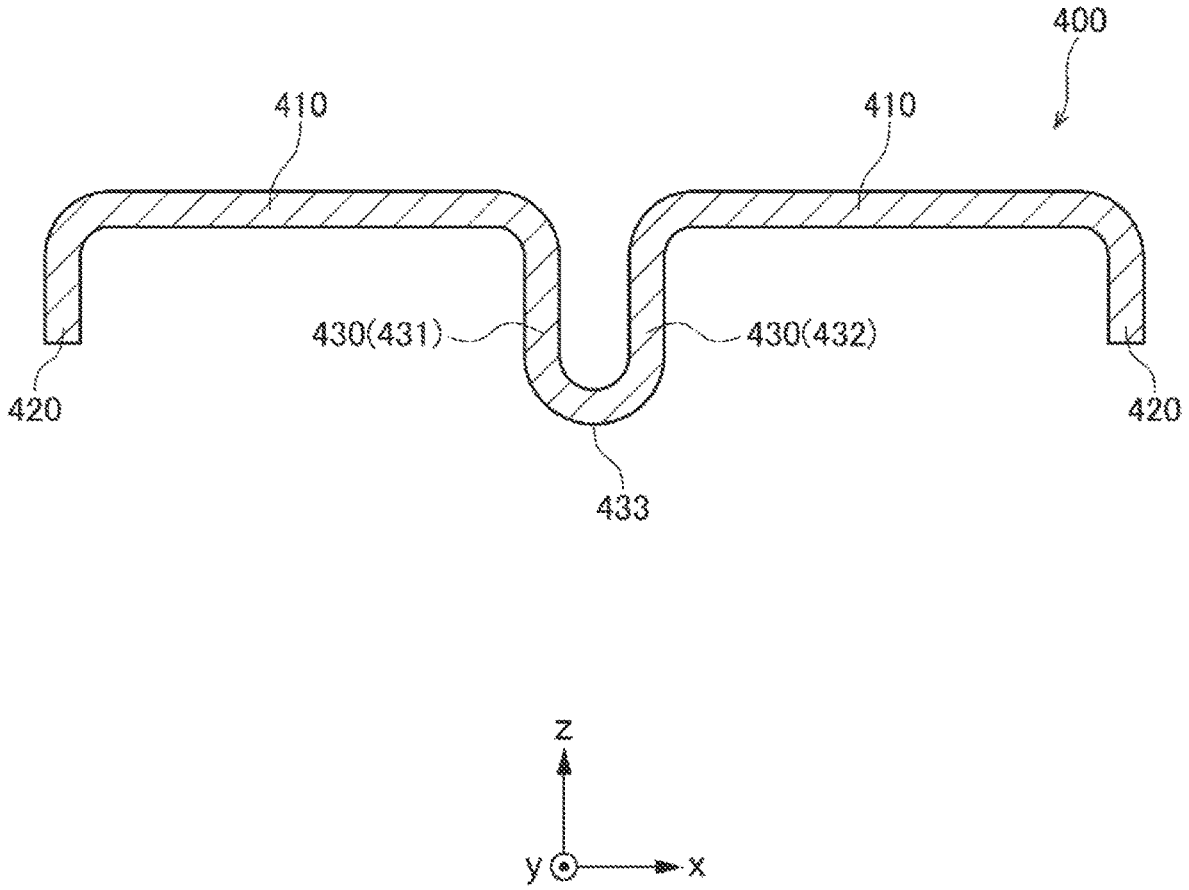
FIG. 5 is a cross-sectional view taken along a line V-V of FIG. 4.

The specific configuration of the reinforcing plate 400 will be described. As described above, the reinforcing plate 400 is a plate-shaped member arranged at a position below the tubes 130 and 230 located on the lowermost side. The reinforcing plate 400 is formed as an elongated plate-shaped member, and is arranged so that the longitudinal direction of the reinforcing plate 400 is along the longitudinal direction of the tube 130, 230. As shown in FIGS. 4 and 5, the reinforcing plate 400 has a flat portion 410, a folded portion 420, and a bent portion 430.

The flat portion 410 is formed in a flat plate shape and occupies most of the reinforcing plate 400. The normal direction of the flat portion 410 is along the z-axis.

The folded portion 420 is a substantially flat part formed so as to extend downward in the −z direction from each end of the flat portion 410 in the x direction. The bent portion 430 is formed by bending the central part of the flat portion 410 in the x direction so as to project downward, that is, in the −z direction. The bent portion 430 is formed so as to extend linearly along the longitudinal direction of the reinforcing plate 400, the tube 130, etc., that is, along the y direction.

The reinforcing plate 300 also has a bent portion (not shown) similar to the bent portion 430. By forming such a bent portion, the rigidity of the reinforcing plate 300, 400 is increased.

Figure 6:
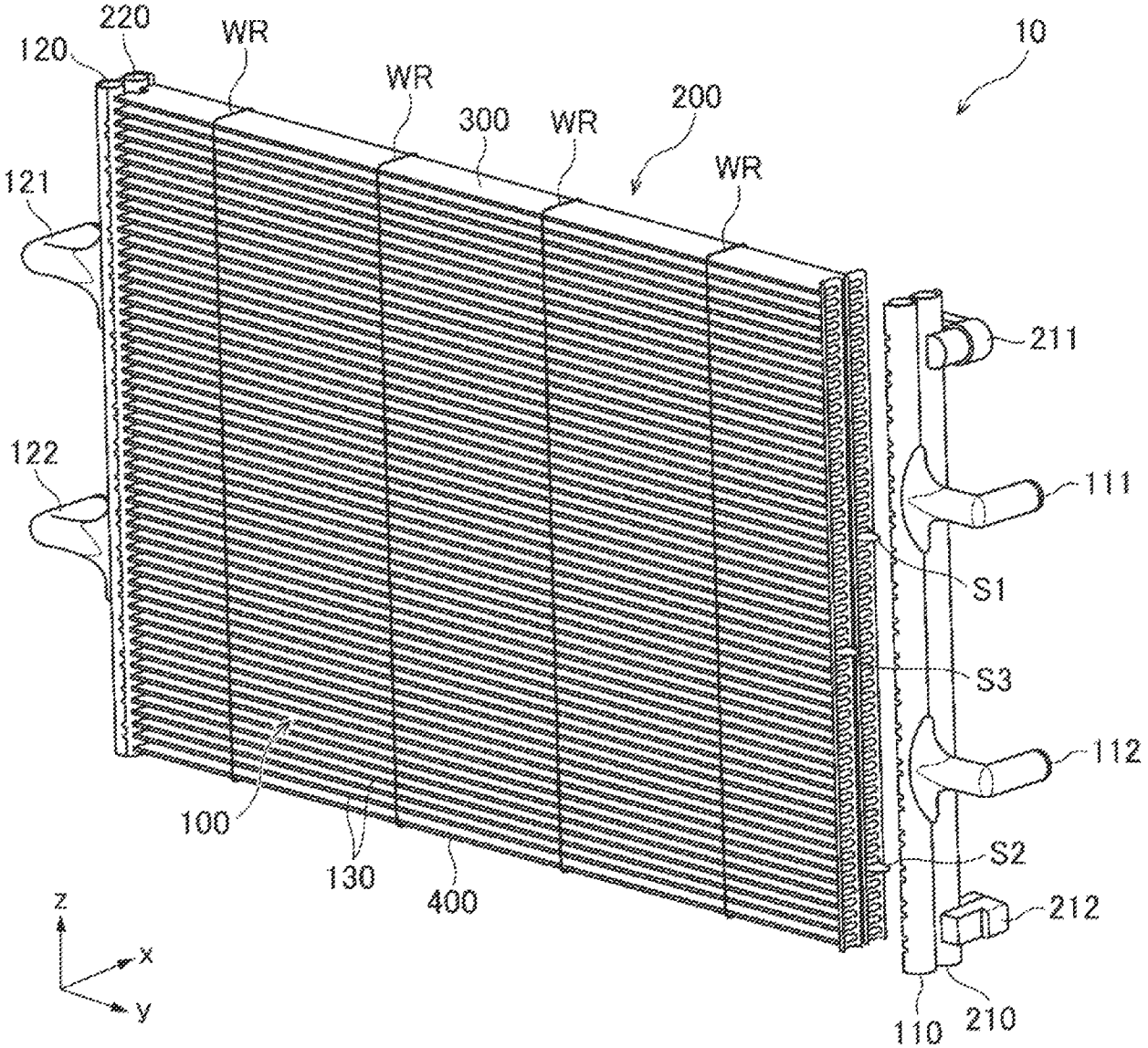
FIG. 6 is a diagram showing a wire attached to the heat exchanger.

At the time of manufacturing the heat exchanger 10, as shown in FIG. 6, plural wires WR are wound around the heat exchanger 10 immediately before the brazing. The wire WR maintains the shape of the heat exchanger 10 before the brazing. The heat exchanger 10 is put into a furnace while the shape is maintained by the wire WR, and the whole including the brazing material is heated. As a result, each part of the heat exchanger 10 is brazed.

In the state of FIG. 6, the heat exchanger 10 is relatively strongly tightened by the wire WR. Therefore, if the rigidity of the reinforcing plate 300, 400 is not sufficient, the reinforcing plate 300, 400 is deformed by the tightening force from the wire WR, and the tubes 130 and fins 140 are deformed accordingly. In order to prevent such deformation, in the present embodiment, the bent portion 430 is formed on the reinforcing plate 300, 400 to increase the rigidity thereof.

Even after the brazing is completed, the rigidity of the reinforcing plate 300, 400 is maintained high by the bent portion 430. As a result, the vibration resistance of the heat exchanger 10 is improved.

The air passing through the heat exchanger 10 in the x direction contains water vapor. Therefore, when the air is cooled as passing through the outside of the tube 230, the water vapor contained in the air becomes condensed water and adheres to the surface of the tube 230 or the fin 140. Further, the condensed water may become frost and adhere to the surface of the tube 230 or the fin 140.

The condensed water and water generated by melting the frost are referred to "condensed water" as a whole. The condensed water moves downward by gravity along the surface of the tube 230 and the fin 140. Eventually, the water reaches the upper surface of the reinforcing plate 400 located on the lower side and flows into the bent portion 430.

Figure 7:
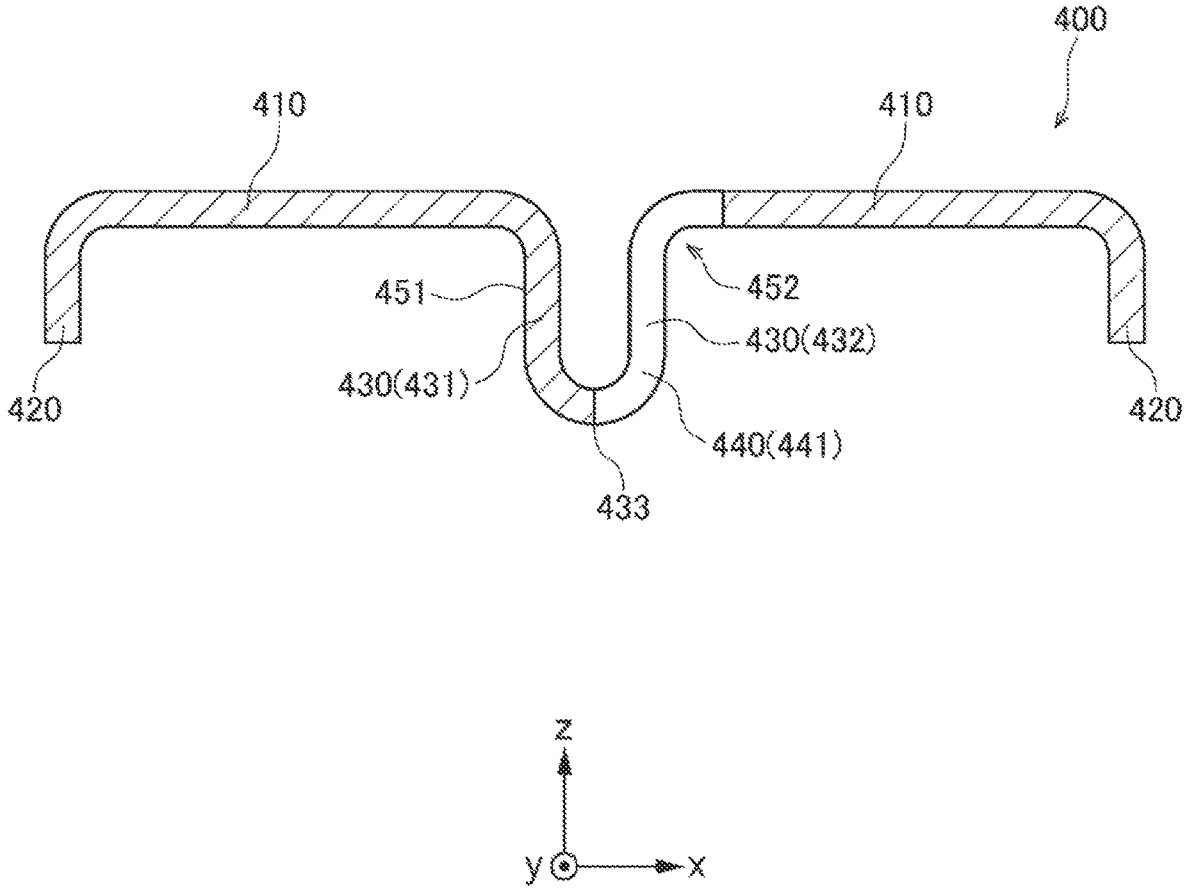
FIG. 7 is a cross-sectional view taken along a line VII-VII of FIG. 4.
Figure 8:
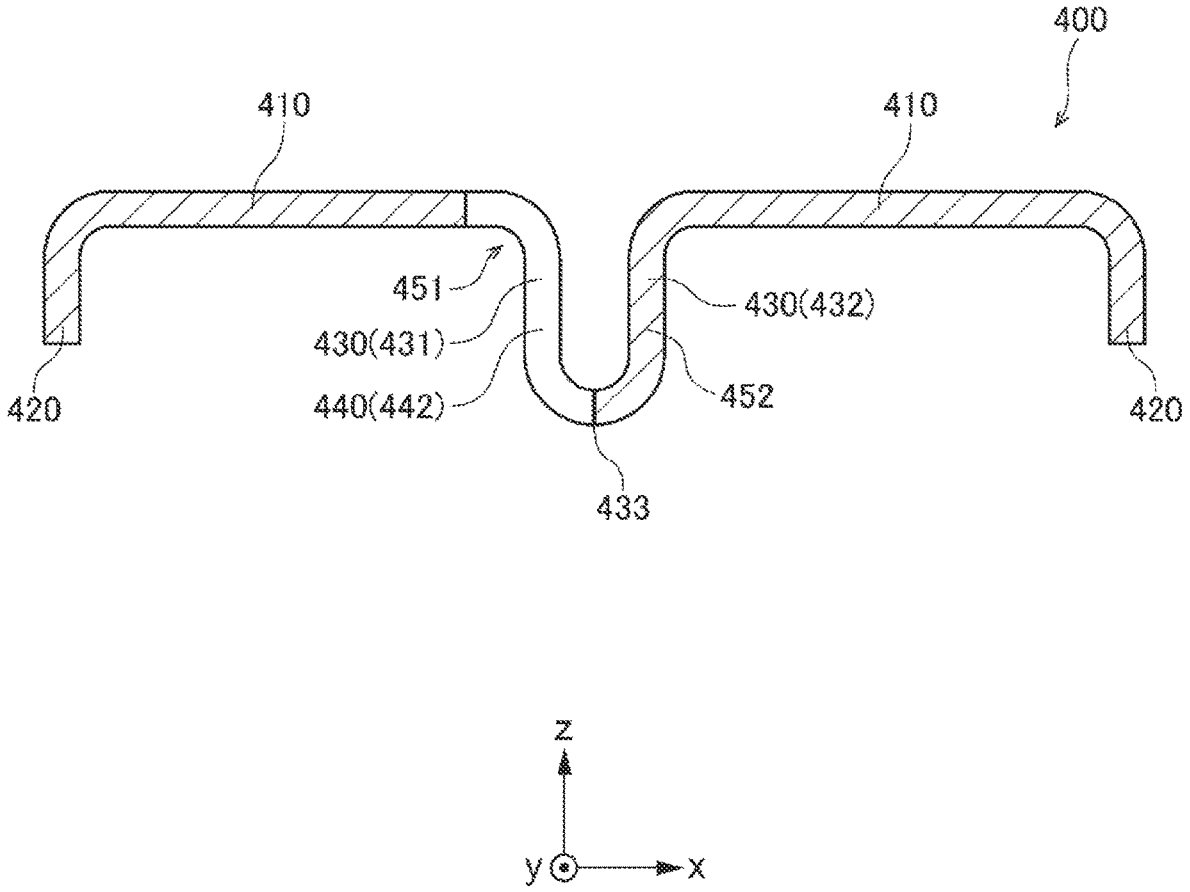
FIG. 8 is a cross-sectional view taken along a line VIII-VIII of FIG. 4.

As shown in FIGS. 4, 7, and 8, the bent portion 430 has plural discharge holes 440. The discharge hole 440 is a through hole formed so as to penetrate the reinforcing plate 400. The condensed water flowing into the bent portion 430 from the upper side is discharged to the outside through any of the discharge holes 440. That is, the discharge hole 440 is a hole for discharging the condensed water arriving from the upper side toward the lower side. The plural discharge holes 440 are formed as in the present embodiment, but the bent portion 430 may have only one discharge hole 440.

The specific shape of the discharge hole 440 will be described. For convenience of explanation, an "upstream region 431" represents a region of the bent portion 430 that is on the upstream side (the −x direction) in the air flow direction with respect to the lower end 433 of the bent portion 430. Further, a "downstream region 432" represents a region of the bent portion 430 that is on the downstream side (the x direction) in the air flow direction with respect to the lower end 433.

FIG. 7 shows a cross section taken along a line VII-VII of FIG. 4. As shown in FIGS. 4 and 7, the discharge hole 440 formed at this position penetrates the downstream region 432 of the bent portion 430 located on the downstream side in the x-direction relative to the lower end 433. The discharge hole 440 positioned on the downstream side in the x-direction is referred to as "first discharge hole 441". In the present embodiment, the upper end of the first discharge hole 441 is located on the flat portion 410. Further, the lower end of the first discharge hole 441 coincides with the lower end 433 of the bent portion 430.

FIG. 8 shows a cross section taken along a line VIII-VIII of FIG. 4. As shown in FIGS. 4 and 8, the discharge hole 440 formed at this position penetrates the upstream region 431 of the bent portion 430 located on the upstream side in the −x direction relative to the lower end 433. The discharge hole 440 positioned on the upstream side in the −x direction is referred to as "second discharge hole 442". In the present embodiment, the upper end of the second discharge hole 442 is located on the flat portion 410. Further, the lower end of the second discharge hole 442 coincides with the lower end 433 of the bent portion 430.

As shown in FIG. 4, in the reinforcing plate 400 according to the present embodiment, the first discharge hole 441 and the second discharge hole 442 are arranged alternately in the y direction in which the bent portion 430 extends.

Figure 9:
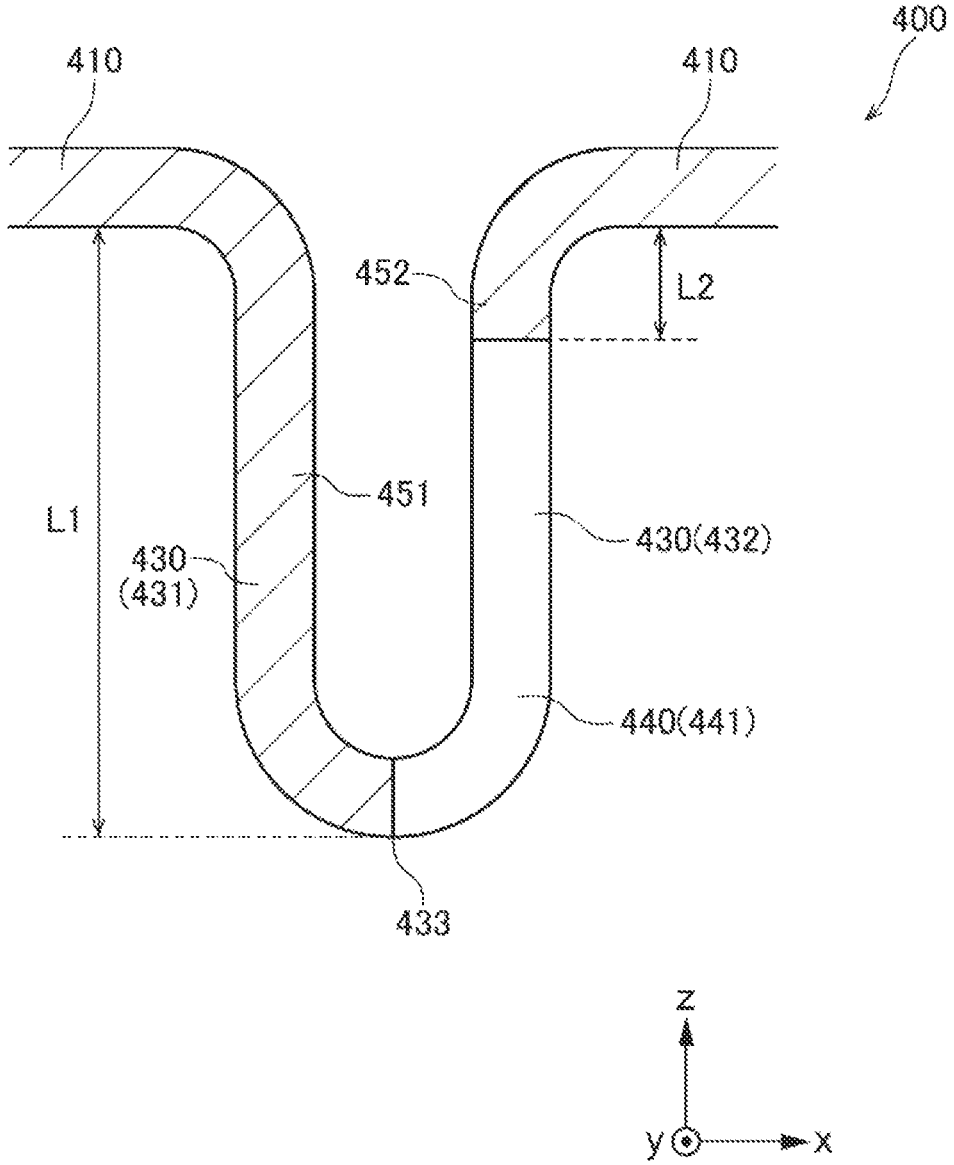
FIG. 9 is a diagram showing a configuration of a reinforcing plate included in a heat exchanger according to a modification example.

The first discharge hole 441 and the like positioned in a manner deviated on the upstream side in the −x direction or the downstream side in the x direction may have various shapes. FIG. 9 shows a modification example of the first discharge hole 441.

In FIG. 9, the lower end of the first discharge hole 441 coincides with the lower end 433 of the bent portion 430, as in FIG. 7. However, the upper end of the first discharge hole 441 is positioned below the flat portion 410.

In the cross section of FIG. 9, a part of the bent portion 430 excluding the discharge hole 440 can be expressed as a plate-shaped "rib" extending from the upper side toward the discharge hole 440. The rib extending from the upper side toward the discharge hole 440 in the upstream region 431 is also referred to as "upstream rib 451". Similarly, the rib extending from the upper side toward the discharge hole 440 in the downstream region 432 is also referred to as "downstream rib 452".

In FIG. 9, the upstream rib 451 has the height dimension L1 along the z-axis. Further, the downstream rib 452 has the height dimension L2 along the z-axis. In FIG. 9, the first discharge hole 441 is formed so as to penetrate a part of the bent portion 430 deviated to the downstream side in the x direction. As a result, the height dimension L1 of the upstream rib 451 and the height dimension L2 of the downstream rib 452 are different from each other, and the height dimension L1 is larger than height dimension L2.

When each of the upstream rib 451 and the downstream rib 452 is defined as described above, in the configuration of the present embodiment shown in FIG. 7, it can be said that the height dimension L2 of the downstream rib 452 is zero. Further, in the configuration shown in FIG. 8, it can be said that the height dimension L1 of the upstream rib 451 is zero. In any case, the height dimension L1 of the upstream rib 451 and the height dimension of the downstream rib 452 are different from each other. As described above, in the configuration in which "the height dimension L1 of the upstream rib 451 and the height dimension L2 of the downstream rib 452 are different from each other", the height dimension L1 may be zero since the upstream rib 451 does not exist, or the height dimension L2 may be zero since the downstream rib 452 does not exist.

Figure 10:
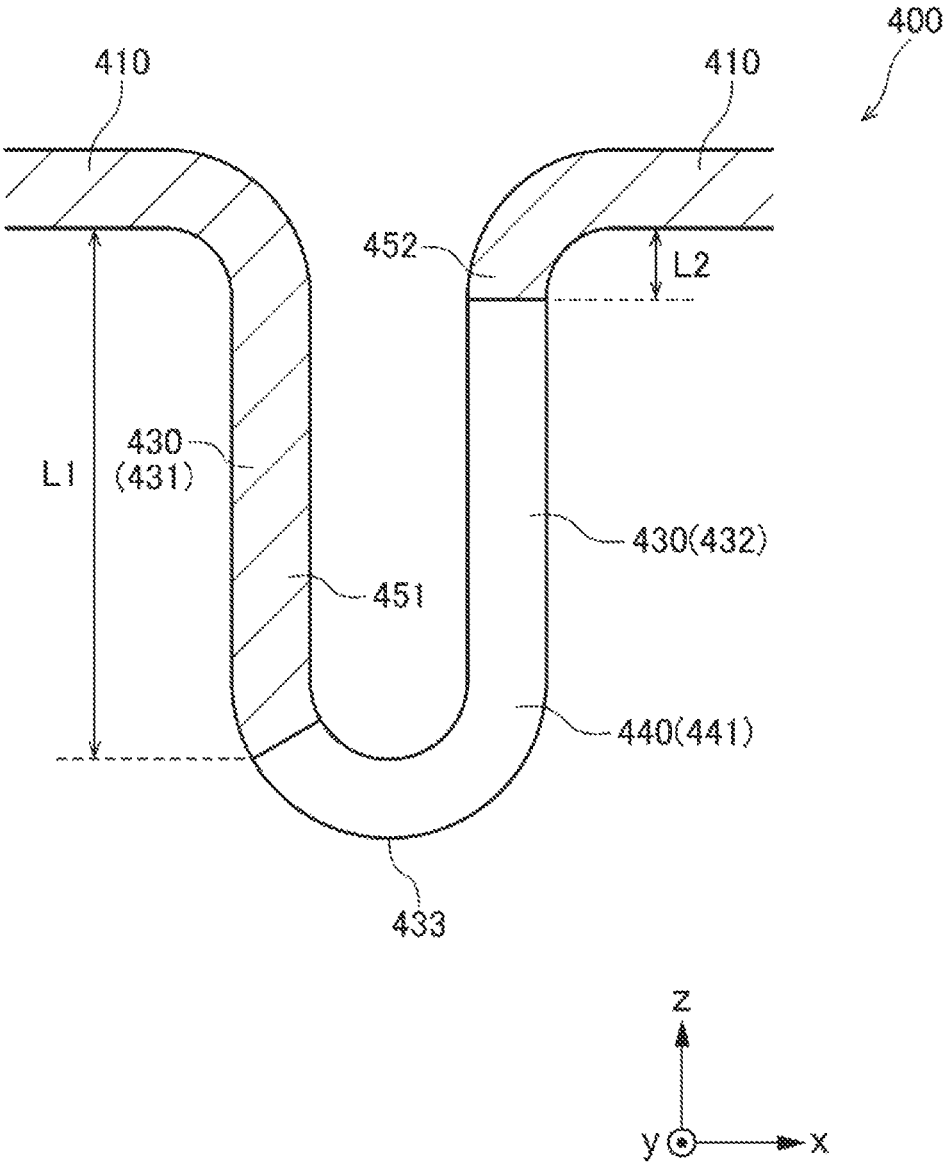
FIG. 10 is a diagram showing a configuration of a reinforcing plate included in a heat exchanger according to another modification.

FIG. 10 shows another modification example of the first discharge hole 441, which is different from that of FIG. 9. In this modification, one end of the first discharge hole 441 is positioned as deviated to the upstream side in the −x direction with respect to the lower end 433, that is, at a position in the middle of the upstream region 431. Further, the other end of the first discharge hole 441 is located as deviated to the downstream side in the x-direction with respect to the lower end 433, that is, in the middle of the downstream region 432. The other end is located higher than the one end.

Therefore, even in the modification example of FIG. 10, the height dimension L1 of the upstream rib 451 and the height dimension L2 of the downstream rib 452 are different from each other, and the height dimension L1 is larger than the height dimension L2. As a result, the first discharge hole 441 is formed so as to penetrate a part of the bent portion 430 deviated to the downstream side in the x direction.

Figure 11:
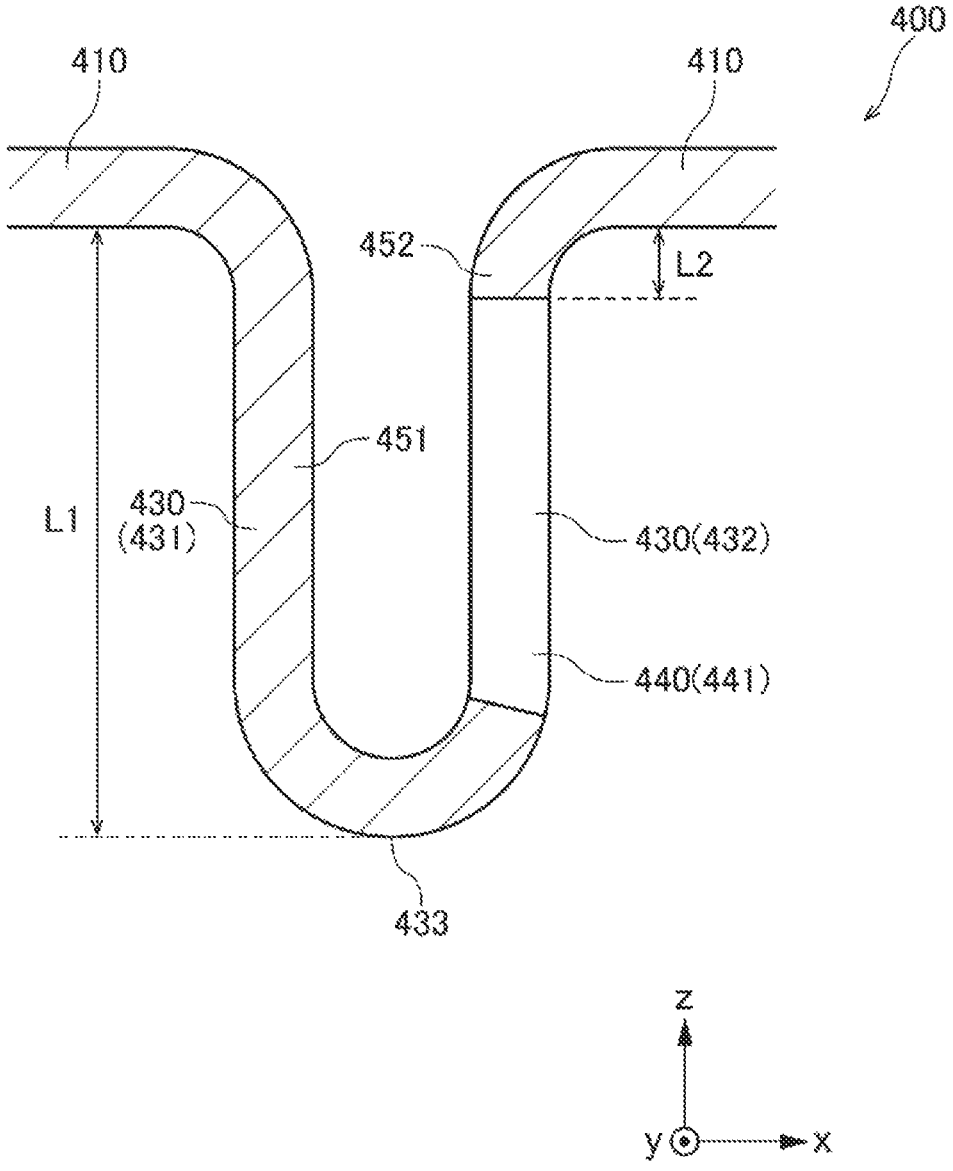
FIG. 11 is a diagram showing a configuration of a reinforcing plate included in a heat exchanger according to another modification.

FIG. 11 shows a modification of the first discharge hole 441, which is different from those of FIGS. 9 and 10. In this modification, the lower end of the first discharge hole 441 is positioned to the downstream side in the x-direction with respect to the lower end 433, that is, at a position in the middle of the downstream region 432. Further, the upper end of the first discharge hole 441 is located on the upper side of the lower end of the first discharge hole 441 and in the middle of the downstream region 432.

Therefore, even in the modification example of FIG. 11, the height dimension L1 of the upstream rib 451 and the height dimension L2 of the downstream rib 452 are different from each other, and the height dimension L1 is larger than the height dimension L2. As a result, the first discharge hole 441 is formed so as to penetrate a part of the bent portion 430 that is deviated to the downstream side in the x direction.

In the configuration as in this modification, as shown in FIG. 11, L1 which is the "height dimension of the upstream rib 451" corresponds to the protrusion amount of the bent portion 430 downward in the −z direction.

FIGS. 9 to 11 show the modifications in which the height dimension L1 is larger than the height dimension L2. Instead of such modifications, the height dimension L2 may be larger than the height dimension L1 by inverting the configuration of each modification so as to be symmetrical with respect to the y-z plane. That is, similarly to the second discharge hole 442 shown in FIG. 8, the discharge hole 440 may be formed so as to penetrate a part of the bent portion 430 that is deviated to the upstream side in the −x direction. In any case, the height dimension L1 of the upstream rib 451 and the height dimension of the downstream rib 452 are different from each other.

The "first discharge hole 441" can be redefined that the height dimension of the upstream rib 451 corresponding to one discharge hole 440 is larger than the height dimension of the downstream rib 452 corresponding to the one discharge hole 440, among the plural discharge holes 440. Each of FIGS. 9, 10 and 11 corresponds to the first discharge hole 441.

Similarly, the "second discharge hole 442" can be redefined that the height dimension of the upstream rib 451 corresponding to one discharge hole 440 is larger than the height dimension of the downstream rib 452 corresponding to the one discharge hole 440, among the plural discharge holes 440. If the configuration shown in FIGS. 9, 10 and 11 is inverted so as to be symmetrical with respect to the y-z plane, the inverted configuration corresponds to the second discharge hole 442. The shape of the second discharge hole 442 of the present embodiment may be configured according to such modifications.

In the reinforcing plate 400 according to the present embodiment, each discharge hole 440 is formed such that the height dimension L1 of the upstream rib 451 and the height dimension of the downstream rib 452 are different from each other, as in each modification as described above. The advantages of such a configuration will be described with reference to FIG. 12.

Figure 12:
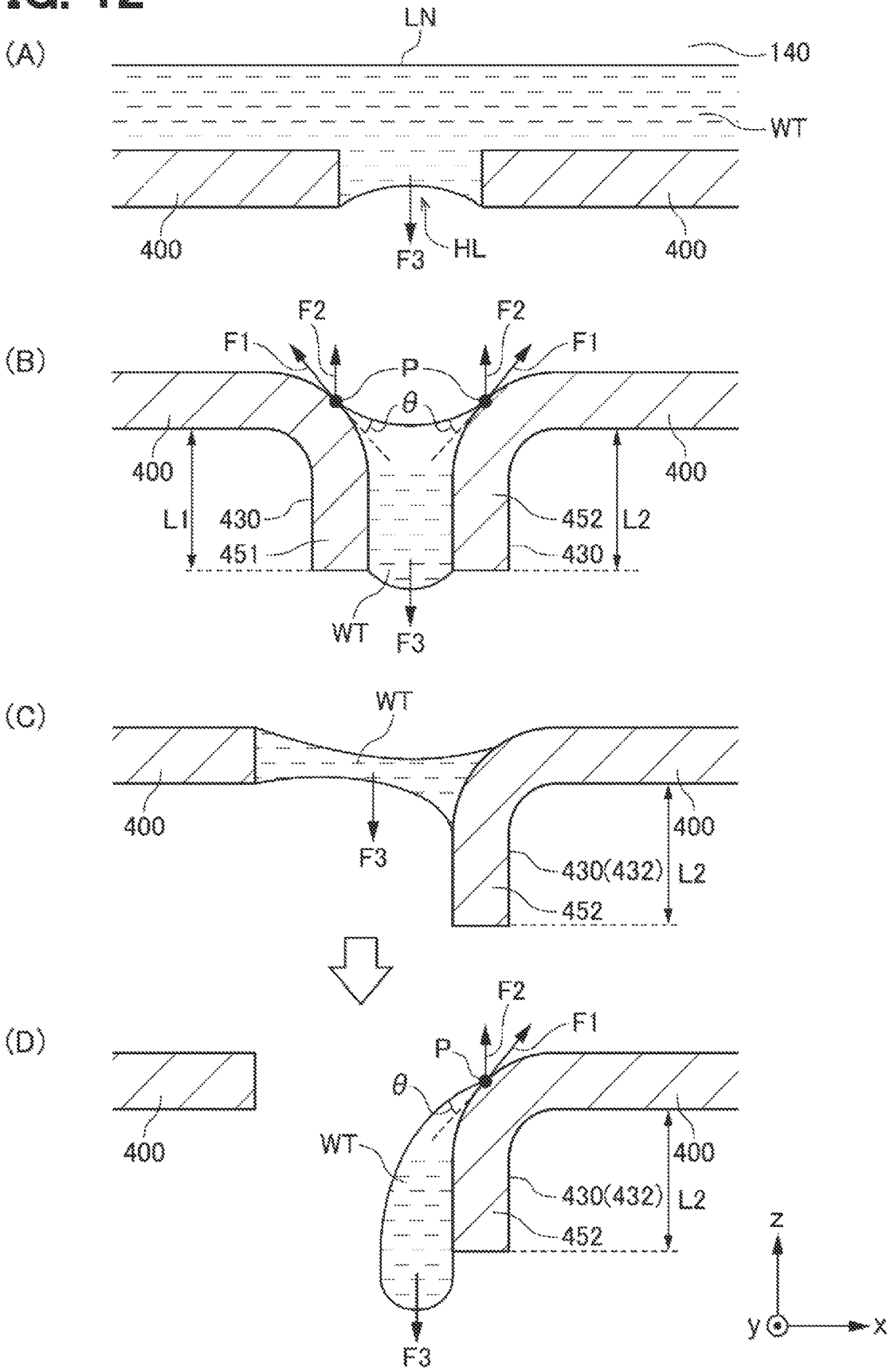
FIG. 12 is a diagram for explaining a force acting on condensed water.

FIG. 12 shows a state (A) of a comparative example in which the condensed water WT stays on the upper surface of the reinforcing plate 400. In this comparative example, the reinforcing plate 400 is generally flat, and the bent portion 430 is not formed. That is, the comparative example is defined by changing the reinforcing plate 400 of the present embodiment to entirely have the flat portion 410. In this example, a through hole HL is formed so as to penetrate the reinforcing plate 400 in the up-down direction.

In the state (A) of FIG. 12, the reference character "LN" represents a boundary between the condensed water WT, the fin 140 existing on the back side of the paper surface, and the air, that is, a line to be a wet edge of the condensed water WT. In the following, the length of the wet edge of the condensed water WT with respect to the surrounding structure is also referred to as "wet edge length LN". Further, the contact angle of the condensed water WT at the wet edge is referred to as "contact angle θ". Further, the surface tension on the surface of the condensed water WT is referred to as "surface tension Y".

A force is applied to the condensed water WT that wets the structure such as the fin 140 so as to be held on the surface of the structure due to the surface tension. If such a force is defined as "holding force", the holding force can be calculated by the following (1).

$$\text{(Holding force)}=\text{(Surface tension } Y)\times\text{(Wet edge length } LN)\times\cos\theta \quad (1)$$

The z-axis component of the holding force calculated as described above acts on the condensed water WT as a force against gravity. In the state (A) of FIG. 12, most of the condensed water WT is present on the upper surface of the reinforcing plate 400 and widely wets the fin 140 in the vicinity thereof. In this case, as the wet edge length LN increases, a relatively large holding force acts on the condensed water WT. The arrow F3 indicates the gravity acting on the condensed water WT. However, since the condensed water WT is held by the large holding force as described above, the condensed water WT is less likely to be discharged downward through the through hole HL.

FIG. 12 shows a state (B) according to another comparative example in which the condensed water WT stays on the upper surface of the reinforcing plate 400. In this comparative example, the bent portion 430 is formed on the reinforcing plate 400 as in the present embodiment. However, in this comparative example, since the discharge hole 440 is formed so as to penetrate the center of the reinforcing plate 400, the height dimension L1 of the upstream rib 451 and the height dimension L2 of the downstream rib 452 are equal to each other.

In such a configuration, the condensed water WT moves downward due to gravity and flows into the bent portion 430. After that, the condensed water WT is held between the upstream rib 451 and the downstream rib 452 facing each other.

The point P shown in the state (B) of FIG. 12 indicates the wet edge of the condensed water WT extending along the depth direction of the paper surface. "F1" in the state (B) of FIG. 12 is a force applied to the condensed water WT by surface tension along the surface of the reinforcing plate 400, that is, the above-mentioned "holding force". "F2" in the state (B) of FIG. 12 is the z-axis component of F1 which is the holding force in the z direction.

Even in the state (B) of FIG. 12, the gravity indicated by the arrow F3 acts on the condensed water WT. In this case, the holding force acting on the condensed water WT is smaller than that in the state (A) of FIG. 12. However, the condensed water WT is in contact with both the upstream rib 451 and the downstream rib 452, and is held by the holding force indicated by "F2" in the z direction from each of the upstream rib 451 and the downstream rib 452. For this reason, the condensed water WT is held by a large holding force, so that the condensed water WT is less likely to be discharged downward through the discharge hole 440.

FIG. 12 shows a state (C) in which the condensed water WT stays on the upper surface of the reinforcing plate 400 according to the present embodiment. The state (C) of FIG. 12 schematically shows a cross section in the vicinity of the second discharge hole 442 shown in FIG. 8.

In this case as well, as in the state (B) of FIG. 12, the condensed water WT moves downward due to gravity and flows into the bent portion 430. However, in the present embodiment, the height dimension of the upstream rib 451 is zero, which is smaller than the height dimension of the downstream rib 452. Therefore, most of the condensed water WT is in contact with the downstream rib 452. Compared to the state (B) of FIG. 12 in which the condensate water WT is held evenly by both the upstream rib 451 and the downstream rib 452, the balance for retaining the condensed water WT is easily lost in the state (C) of FIG. 12. Therefore, the bridge of the condensed water WT is broken in a relatively short time, and the state (C) shifts to the state (D) shown in FIG. 12.

In the state (D) of FIG. 12, the condensed water WT is in contact with only the downstream rib 452. Therefore, the force F2, which is the z-axis component of the holding force, is reduced to half as compared with the state (B) of FIG. 12. Since the holding force applied to the condensed water WT becomes smaller, the condensed water WT moves downward due to the gravity indicated by the arrow F3, and is smoothly discharged to the outside from the second discharge hole 442. Also in the first discharge hole 441, the holding force is reduced to half as described above, so that the condensed water WT is smoothly discharged.

As described above, according to the configuration in which the discharge hole 440 is formed so that the height dimension L1 of the upstream rib 451 and the height dimension L2 of the downstream rib 452 are different from each other, it is possible to sufficiently drain the condensed water. Such an effect can be achieved not only in the same configuration as that of the present embodiment but also in the modifications described with reference to FIGS. 9 to 11.

Figure 19:
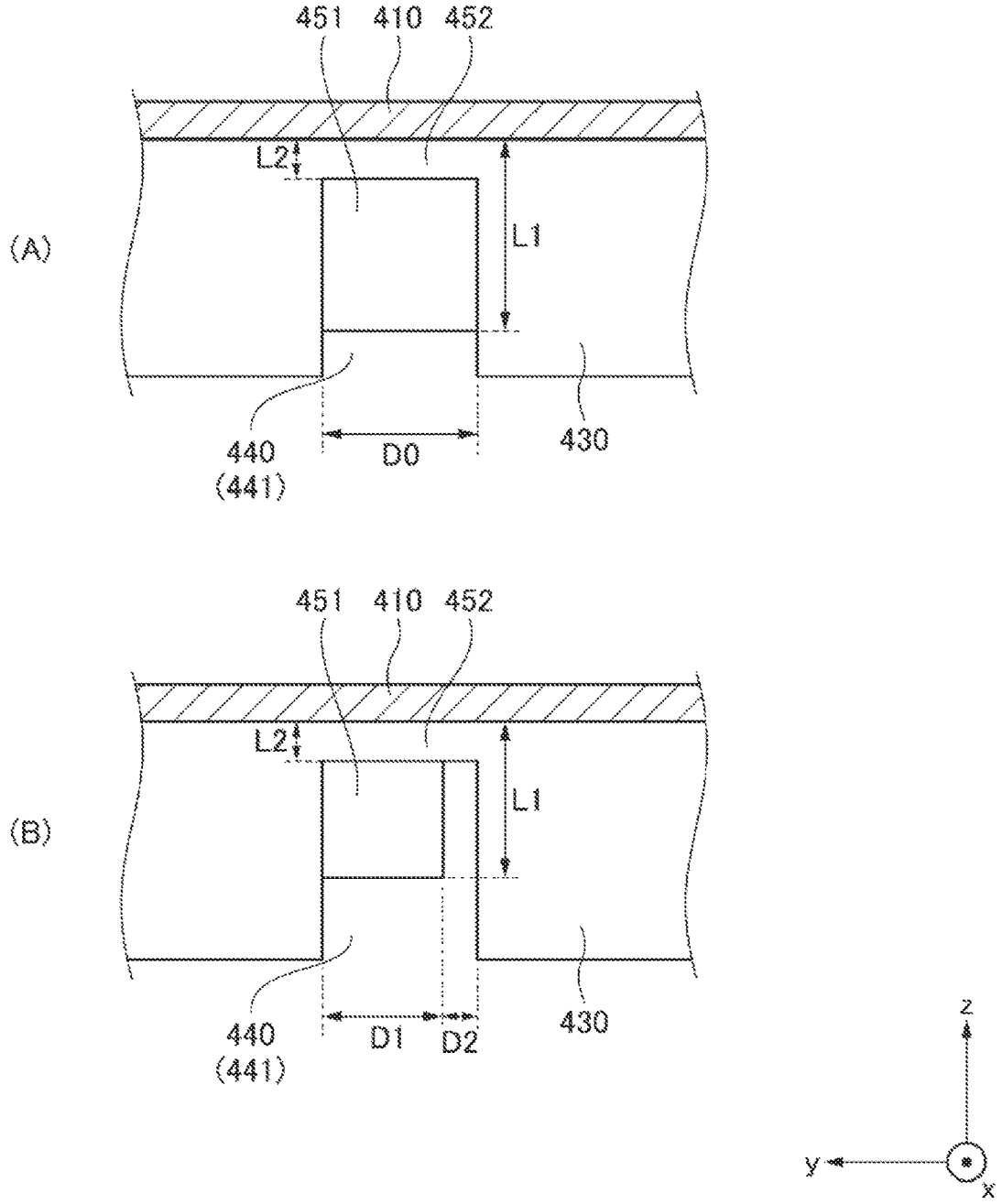
FIG. 19 is a diagram for explaining shapes of an upstream rib and a downstream rib.

FIG. 19 schematically shows a state (A) corresponding to the modification example shown in FIG. 10, and illustrates a part of the bent portion 430 having the first discharge hole 441 as viewed in the x-direction. As shown in FIG. 19, in this configuration, the height dimension (L1) of the upstream rib 451 and the height dimension (L2) of the downstream rib 452 are different from each other, in the entire range D0 of the discharge hole 440 along the y direction (that is, the longitudinal direction of the tube 130).

In contrast, in a state (B) of FIG. 19, the height dimension (L1) of the upstream rib 451 and the height dimension (L2) of the downstream rib 452 are different from each other only in a first range D1 of the discharge hole 440 along the y direction. In the other range D2 of the discharge hole 440 along the y direction, the height dimension (L2) of the upstream rib 451 and the height dimension (L2) of the downstream rib 452 are the same as each other. Even when the discharge hole 440 is formed so as to have such a shape, the holding force for holding the condensed water WT can be reduced, compared with the configuration in which the height dimension of the upstream rib 451 and the height dimension of the downstream rib 452 are the same in the entire range D0. Thus, the above-mentioned effect can be obtained.

As described above, the height dimension of the upstream rib 451 and the height dimension of the downstream rib 452 are different from each other in at least partially in the longitudinal direction of the tube 130. Such a configuration can be applied to the present embodiment shown in FIGS. 7 and 8, the modifications shown in FIGS. 9 to 11, and a configuration in which the modification is inverted so as to be symmetrical with respect to the y-z plane (that is, a configuration of the second discharge hole 442 and its surroundings).

The first discharge hole 441 and the second discharge hole 442 are defined as follows. In the first discharge hole 441, the height dimension of the upstream rib 451 corresponding to one discharge hole is larger than the height dimension of the downstream rib 452 corresponding to the one discharge hole at least partially in the longitudinal direction of the tube 130. Further, in the second discharge hole 442, the height dimension of the downstream rib 452 corresponding to one discharge hole is larger than the height dimension of the upstream rib 451 corresponding to the one discharge hole at least partially in the longitudinal direction of the tube 130. As described above, in the reinforcing plate 400 according to the present embodiment, two types of holes including the first discharge hole 441 and the second discharge hole 442 are formed as the discharge holes 440. Of these, the first discharge hole 441 makes it possible to discharge the condensed water more smoothly than the second discharge hole 442.

This reason will be described. The arrow AR1 shown in FIG. 13 indicates the flow of air through the heat exchanger 10. Further, the arrow AR2 shown in FIG. 13 indicates the flow of condensed water pushed out by the flow of air. As shown by the arrow AR2, the condensed water staying on the upper surface of the reinforcing plate 400 moves in the x direction by receiving the force due to the air flow, so-called "ram pressure", and flows into the bent portion 430. Since the first discharge hole 441 is widely open to the downstream side in the x-direction, the condensed water that has moved in the x-direction and reached the bent portion 430 retains a part of the momentum in the x-direction, and is discharged in the x direction through the first discharge hole 441. Therefore, as compared with the second discharge hole 442, the condensed water is discharged from the first discharge hole 441 more smoothly.

Figure 14:
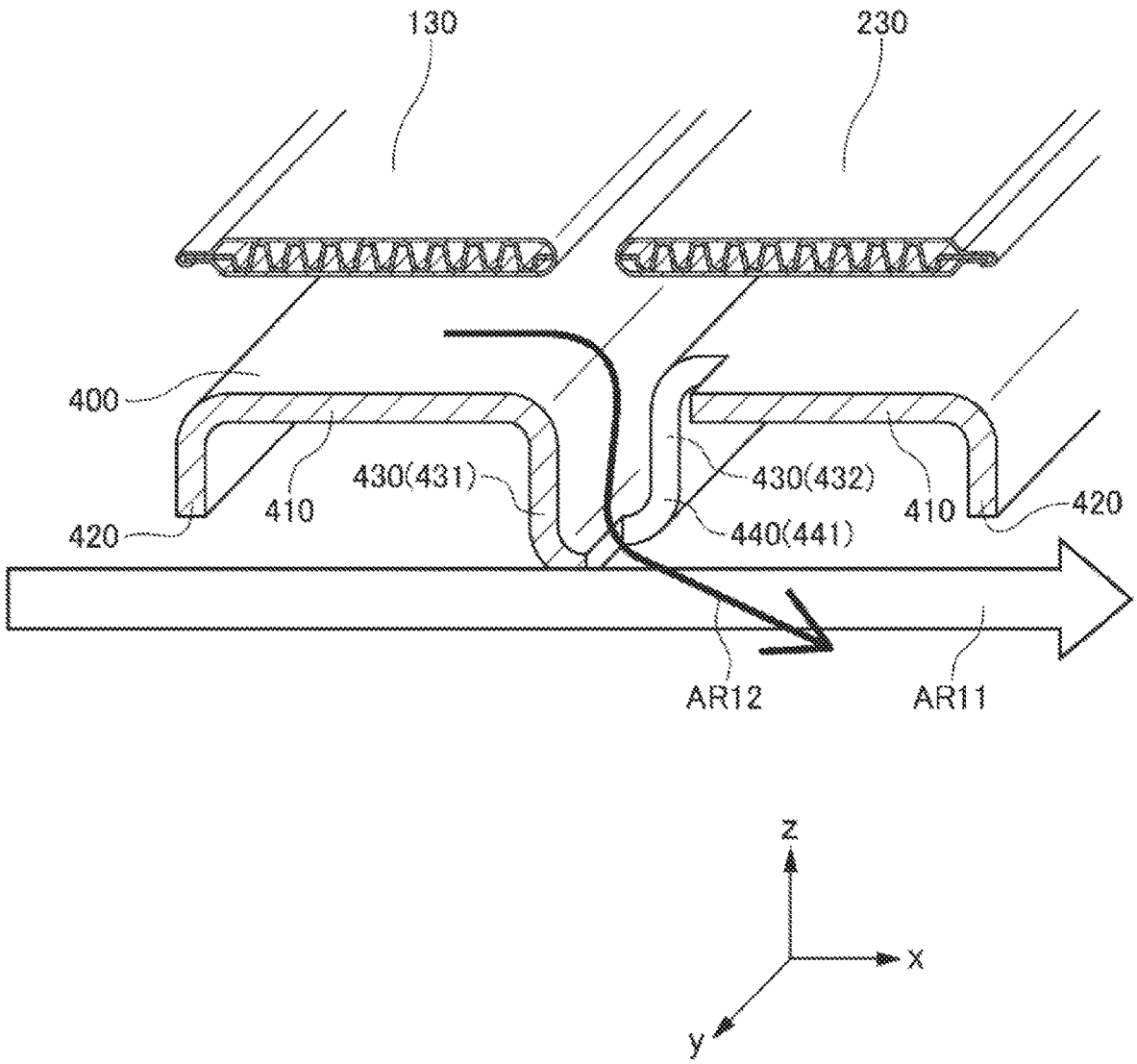
FIG. 14 is a diagram for explaining a force acting on condensed water.

The arrow AR11 shown in FIG. 14 indicates the flow of air passing through the lower side of the heat exchanger 10, that is, further lower side of the reinforcing plate 400. Such an air flow is generated, for example, when a shutter arranged on the upstream side of the heat exchanger 10 in the −x direction is closed, and air generated by traveling the vehicle or a fan flows to the downstream side from the outer peripheral portion of the shutter. The air indicated by the arrow AR11 does not pass through the upper side of the reinforcing plate 400, but only through the lower side.

It should be noted that a flow of air that passes only through the lower side of the reinforcing plate 400 may occur even when the shutter is not arranged on the upstream side of the heat exchanger 10 in the −x direction. For example, if a gap between the reinforcing plate 400 and the tube 130 is covered by a peripheral structure (not shown) on the upstream side in the −x direction, an air flow as indicated by the arrow AR11 may occur.

Figure 13:
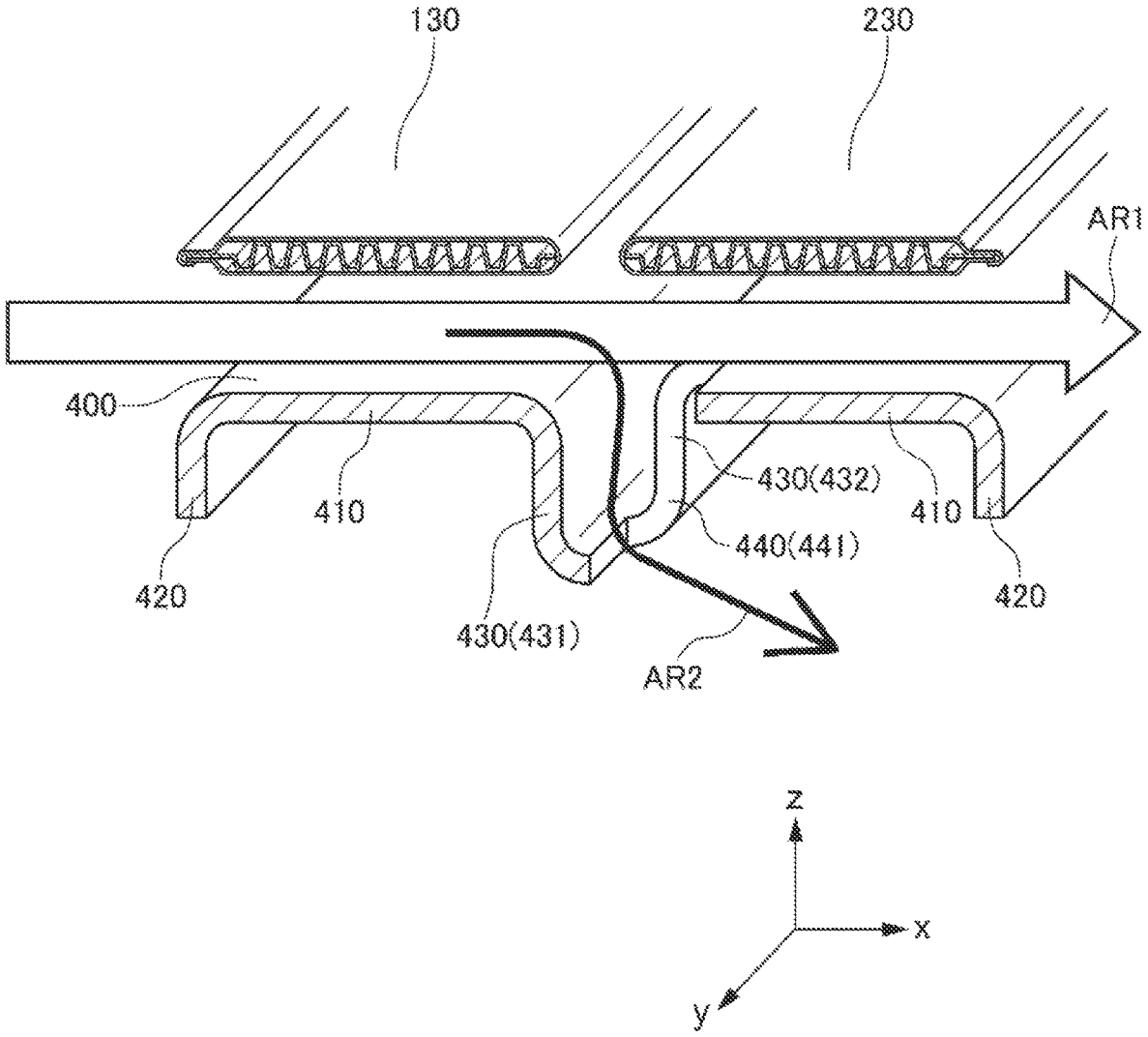
FIG. 13 is a diagram for explaining a force acting on condensed water.

When an air flow as indicated by the arrow AR11 occurs, a negative pressure due to the air flow is generated in the vicinity of the bent portion 430. The condensed water accumulated inside the bent portion 430 is drawn out from the first discharge hole 441 to the downstream side in the x-direction by the negative pressure, and is discharged to the outside. In FIG. 13, the path through which the condensed water flows is indicated by the arrow AR12. In the present embodiment, due to the first discharge hole 441, the condensed water can be discharged more smoothly.

Figure 15:
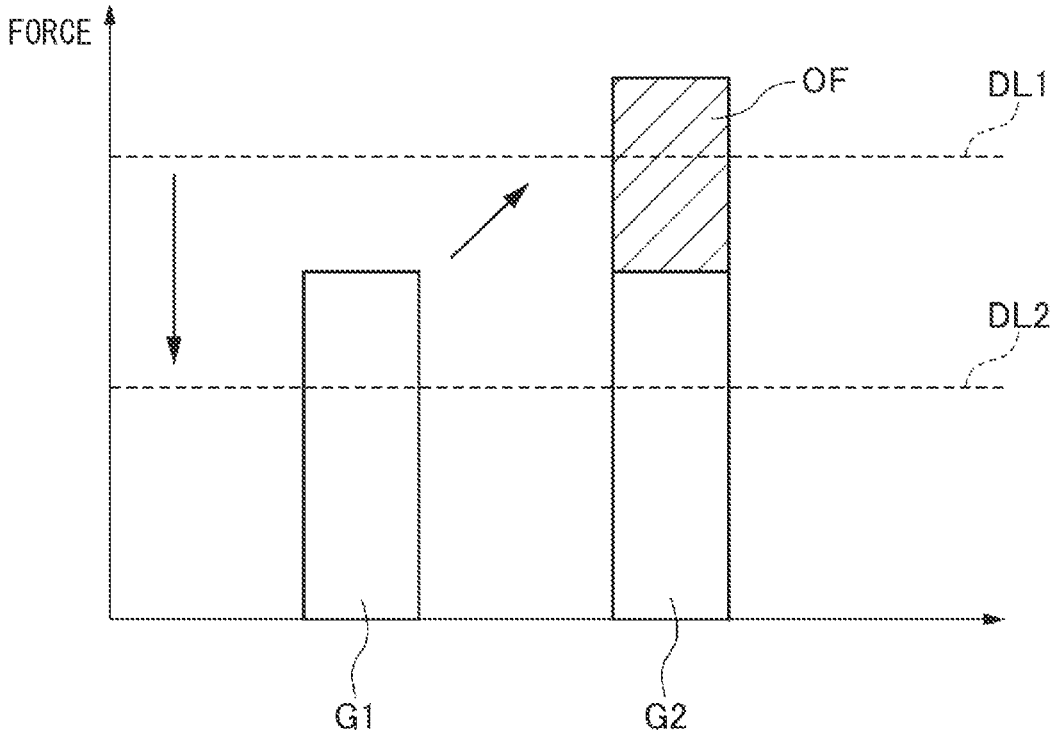
FIG. 15 is a diagram for explaining a force acting on condensed water.

In FIG. 15, the dotted line DL1 shows the magnitude of the holding force applied to the condensed water in the z direction in the state (B) of FIG. 12, where the height dimension L1 of the upstream rib 451 and the height dimension L2 of the downstream rib 452 are equal to each other throughout the longitudinal direction of the tube 130. Further, the height of the bar G1 shown in FIG. 15 indicates the magnitude of gravity applied to the condensed water. The height of the bar G1 is lower than that of the dotted line DL1. This indicates that in the state (B) representing the comparative example in FIG. 12, the holding force is larger than the gravity, so that the condensed water is less likely to be discharged to the outside.

In FIG. 15, the dotted line DL2 shows the magnitude of the holding force applied to the condensed water in the z direction in the configuration according to the present embodiment, in which the height dimension L1 of the upstream rib 451 and the height dimension L2 of the downstream rib 452 are different from each other at least partially in the longitudinal direction of the tube 130. As described with reference to FIG. 12, the holding force applied to the condensed water in the configuration of the present embodiment is reduced to half, that is, the dotted line DL1, as compared with the state (B) of FIG. 12. As a result, in the configuration of the present embodiment, the holding force indicated by the dotted line DL2 is smaller than the gravity indicated by the bar G1, so that the condensed water is smoothly discharged.

The bar G2 shown in FIG. 15 is obtained by adding the bar OF to the bar G1. The bar OF schematically represents the force due to the air flow described with reference to FIG. 13 or the force due to the negative pressure described with reference to FIG. 14, by converting into the force for discharging the condensed water. Therefore, the total height obtained by adding the bar OF to the bar G1 corresponds to the force for discharging the condensed water to the outside in the configuration of the present embodiment. As shown in FIG. 15, the force greatly exceeds the dotted line DL2 which is the holding force. Therefore, in the present embodiment, the condensed water is discharged more smoothly.

In view of the discharge efficiency of condensed water, it seems better to make all the discharge holes 440 as the first discharge holes 441. However, in the present embodiment, such a configuration is not adopted, and the discharge hole 440 includes both the first discharge hole 441 and the second discharge hole 442. As shown in FIG. 4, the first discharge hole 441 and the second discharge hole 442 are arranged alternately in the longitudinal direction of the tube 130.

In such a configuration, if the reinforcing plate 400 is erroneously assembled at the time of assembling the heat exchanger 10, specifically, if the reinforcing plate 400 is assembled in a state of being rotated 180 degrees around the z-axis from the state of FIG. 4, a part of the discharge holes 440 can function as the first discharge hole 441. The "a part of the discharge hole 440" means a discharge hole 440 that was planned to be a second discharge hole 442 when the reinforcing plate 400 was normally assembled.

It is preferable that the shape of the reinforcing plate 400 is symmetrical so as to be the same shape even when rotated 180 degrees around the z-axis, in order to achieve exactly the same discharge performance, even if the reinforcing plate 400 is erroneously assembled as described above.

Figure 16:
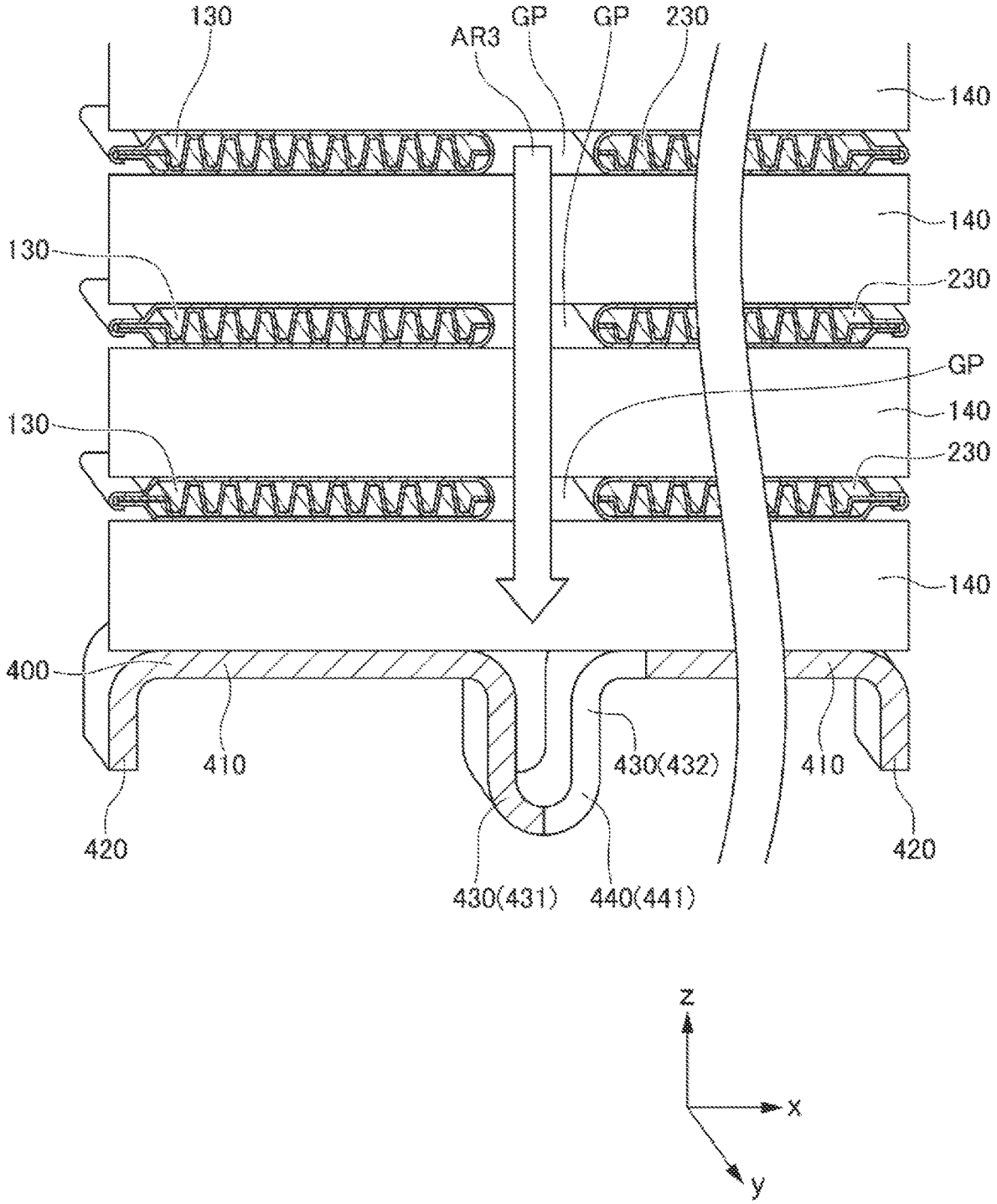
FIG. 16 is a diagram for explaining a path of movement of condensed water.

The heat exchanger 10 according to the present embodiment includes the tube 130 and the tube 230. The tubes 130 are arranged in the vertical direction, and correspond to the "first tube" in the present embodiment. The tubes 230 are arranged in the vertical direction at a position downstream of the tube 130 in the air flow direction, and correspond to the "second tube" in the present embodiment. As described above, the gap GP is formed between the tubes 130 and the tubes 230 adjacent to each other in the air flow direction. As shown in FIG. 16, the bent portion 430 in the present embodiment is formed at a position directly below the gap GP formed between the tube 130 and the tube 230.

In such a configuration, most of the condensed water generated on the surface of the tube 130, the tube 230, and the fin 140 is moved downward through the gap GP by gravity and flows into the bent portion 430 directly under the gap GP. After that, as described above, the condensed water is discharged to the outside from the discharge hole 440. In FIG. 16, the flow of condensed water moving downward through the gap GP as described above is indicated by the arrow AR3.

As described above, in the present embodiment, the bent portion 430 is located directly below the gap GP, so that the condensed water can be discharged more smoothly.

A second embodiment will be described. Hereinafter, only parts different from the first embodiment will be described, and description of parts common to the first embodiment will be omitted for brevity where appropriate.

Figure 17:
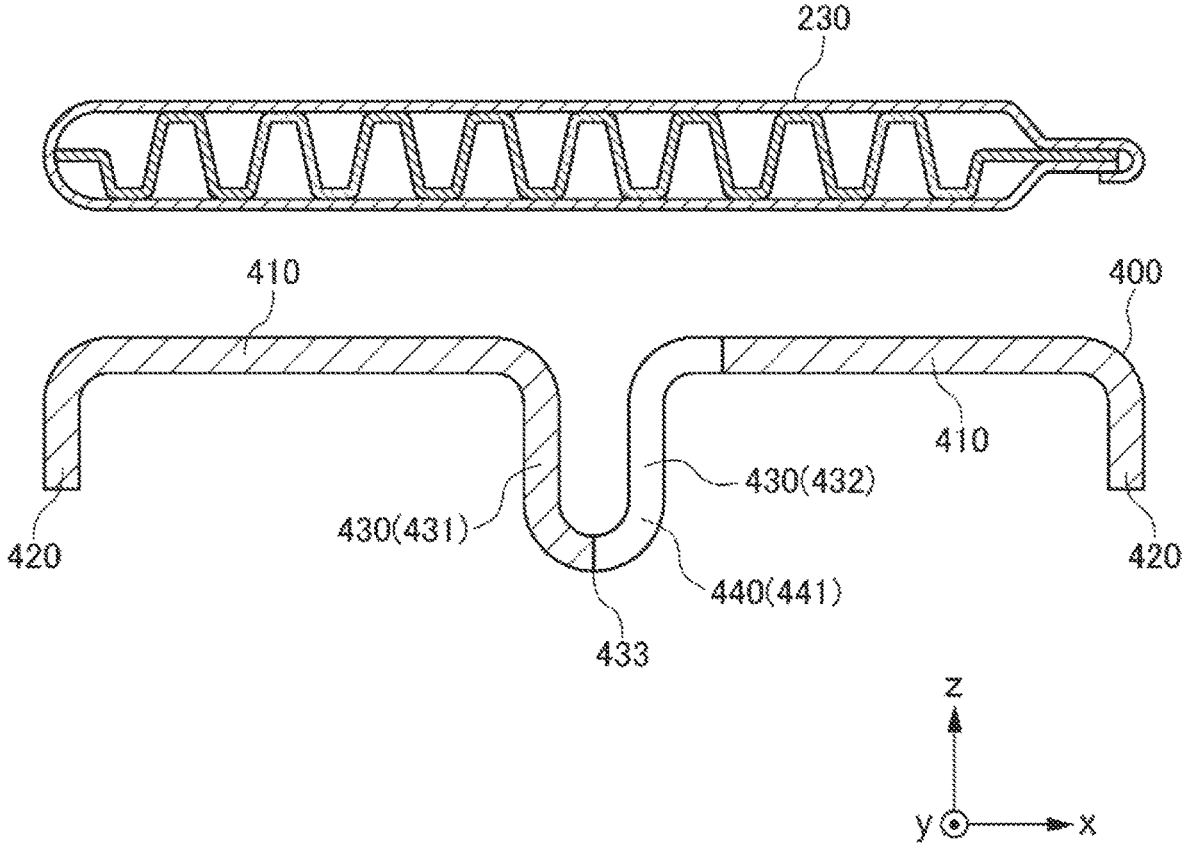
FIG. 17 is a diagram showing a configuration of a heat exchanger according to a second embodiment.

The heat exchanger 10 according to the present embodiment does not include the radiator 100 of the first embodiment, and is composed of the evaporator 200. That is, the heat exchanger 10 is configured as a single heat exchanger, not a composite heat exchanger. Therefore, as shown in FIG. 17, the width dimension of the reinforcing plate 400 in the x direction is substantially the same as the width dimension of the tube 230 in the x direction. In this embodiment, there is no gap GP of the first embodiment.

The reinforcing plate 400 according to the present embodiment is formed as in the first embodiment, at the central part of the flat portion 410 in the x direction. Even in such a configuration, the same effect as that described in the first embodiment is obtained. As described above, the shape of the reinforcing plate 400 for improving the drainage property can be applied to not only the composite heat exchanger as in the first embodiment, but also a single heat exchanger having only one row of the tubes 230 arranged in the vertical direction.

A third embodiment will be described. Hereinafter, only parts different from the first embodiment will be described, and description of parts common to the first embodiment will be omitted for brevity where appropriate.

Figure 18:
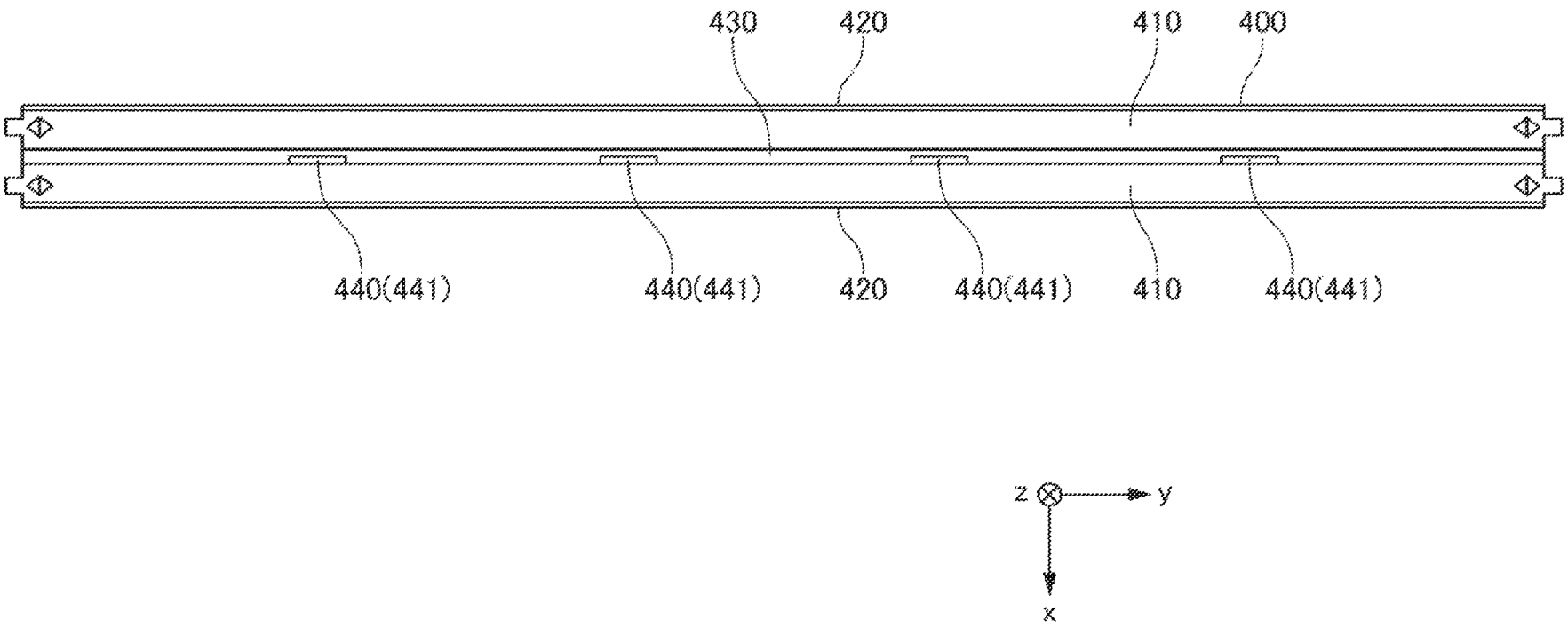
FIG. 18 is a diagram showing a configuration of a reinforcing plate included in a heat exchanger according to a third embodiment.

This embodiment differs from the first embodiment only in the arrangement of the discharge holes 440 formed in the reinforcing plate 400. As shown in FIG. 18, in the present embodiment, all the discharge holes 440 are formed as the first discharge hole 441 positioned as deviated to the downstream side in the x direction, and there is no second discharge hole 442. The shape of each discharge hole 440 is the same as the shape of the first discharge hole 441 of the first embodiment described with reference to FIG. 7. However, each discharge hole 440 may have the shape as shown in any of FIGS. 9, 10, and 11. At that time, a part or all of the discharge holes 440 may be shaped as in the example described with reference to the state (B) of FIG. 19. That is, the height dimension of the upstream rib 451 and the height dimension of the downstream rib 452 may be different from each other in a part in the longitudinal direction of the tube 130.

As described above, in the present embodiment, all of the discharge holes 440 are formed such that the height dimension of the upstream rib 451 corresponding to one discharge hole 440 is higher than the height dimension of the downstream rib 452 corresponding to the one discharge hole 440 at least in part in the longitudinal direction of the tube 130. With such a configuration, it is possible to facilitate the discharge of water from all the discharge holes 440 by the flow of air as described with reference to FIGS. 13 and 14. The reinforcing plate 400 having such a configuration may be adopted in the second embodiment described above.

For example, when it is possible to prevent an error in the assembly direction of the reinforcing plate 400 by some mechanism, it is desirable to further facilitate the discharge of condensed water by configuring all the discharge holes 440 as the first discharge holes as in the present embodiment.

The present embodiment has been described above with reference to the specific examples. However, the present disclosure is not limited to those specific examples. Those specific examples that are appropriately modified in design by those skilled in the art are also encompassed in the scope of the present disclosure, as far as the modified specific examples have the features of the present disclosure. Each element included in each of the specific examples described above and the arrangement, condition, shape, and the like thereof are not limited to those illustrated, and can be changed as appropriate. The combinations of elements included in each of the above described specific examples can be appropriately modified as long as no technical inconsistency occurs.

What is claimed is:

1. A heat exchanger configured to exchange heat between a heat medium and an air, the heat exchanger comprising:

a plurality of tubes arranged in an up-down direction, through which the heat medium passes; and a reinforcing plate arranged on a lower side of a lowermost tube of the plurality of tubes, wherein the reinforcing plate has a bent portion protruding downward and extending along a longitudinal direction of the plurality of tubes, the bent portion includes at least one discharge hole to discharge a condensed water flowing from an upper side toward a lower side, the bent portion has a lower end to define an upstream region upstream of the lower end in a flow direction of air and a downstream region downstream of the lower end in the flow direction of air, the discharge hole is formed by an upstream rib extending from the upper side toward the discharge hole in the upstream region and a downstream rib extending from the upper side toward the discharge hole in the downstream region, wherein a height dimension of the upstream rib is different from a height dimension of the downstream rib partially at least along the longitudinal direction of the plurality of tubes, and the height dimension of the upstream rib forming the one discharge hole is larger than the height dimension of the downstream rib forming the one discharge hole partially at least along the longitudinal direction of the plurality of tubes.

2. The heat exchanger according to claim 1, wherein the discharge hole is one of a plurality of discharge holes including a first discharge hole in which the height dimension of the upstream rib forming the one discharge hole is larger than the height dimension of the downstream rib forming the one discharge hole partially at least along the longitudinal direction of the plurality of tubes, and a second discharge hole in which the height dimension of the downstream rib forming the one discharge hole is larger than the height dimension of the upstream rib forming the one discharge hole partially at least along the longitudinal direction of the plurality of tubes, and the first discharge hole and the second discharge hole are alternately arranged in the longitudinal direction of the plurality of tubes.

3. The heat exchanger according to claim 1, wherein the discharge hole is one of a plurality of discharge holes, in all of which the height dimension of the upstream rib forming the one discharge hole is larger than the height dimension of the downstream rib forming the one discharge hole partially at least along the longitudinal direction of the plurality of tubes.

4. The heat exchanger according to claim 1, wherein the plurality of tubes includes a plurality of first tubes arranged in the up-down direction, and a plurality of second tubes arranged in the up-down direction at downstream of the plurality of first tubes in the flow direction of air, a gap is formed between the plurality of first tubes and the plurality of second tubes adjacent to each other in the flow direction of air, and the bent portion is positioned directly below the gap.

5. The heat exchanger according to claim 1, wherein the one discharge hole is deviated to a downstream side with respect to the lower end of the bent portion in the flow direction of air.

6. The heat exchanger according to claim 1, wherein the reinforcing plate has a flat portion formed in a flat plate shape having a normal direction along the up-down direction, a lower surface of the flat portion being flat along the flow direction of air, the height dimension of the upstream rib represents a distance from the lower surface of the flat portion to a lower end of the upstream rib, and the height dimension of the downstream rib represents a distance from the lower surface of the flat portion to a lower end of the downstream rib.

7. The heat exchanger according to claim 6, wherein the height dimension of the upstream rib is equal to a height of the bent portion in the up-down direction, and the height dimension of the downstream rib is zero.

8. The heat exchanger according to claim 6, wherein the height dimension of the upstream rib is equal to a height of the bent portion in the up-down direction, and the height dimension of the downstream rib is larger than zero and smaller than a half of the height of the bent portion in the up-down direction.

9. The heat exchanger according to claim 6, wherein the height dimension of the upstream rib is smaller than a height of the bent portion in the up-down direction, and the height dimension of the downstream rib is larger than zero and smaller than a half of the height of the bent portion in the up-down direction.

10. The heat exchanger according to claim 1, wherein the height dimension of the upstream rib is equal to a height of the bent portion in the up-down direction, the height dimension of the downstream rib is larger than zero and smaller than a half of the height of the bent portion in the up-down direction, and the upstream rib is located to overlap with the downstream rib in the flow direction of air.

11. The heat exchanger according to claim 6, wherein the height dimension of the downstream rib is zero.

12. The heat exchanger according to claim 6, wherein the height dimension of the downstream rib is larger than zero and smaller than a half of a height of the bent portion in the up-down direction.

13. The heat exchanger according to claim 6, wherein the height dimension of the upstream rib is larger than a half of a height of the bent portion in the up-down direction, and is smaller than the height of the bent portion in the up-down direction.

* * * * *